US006955420B2

(12) United States Patent
Ito

(10) Patent No.: US 6,955,420 B2
(45) Date of Patent: Oct. 18, 2005

(54) THIN PLATE STACKED STRUCTURE AND INK-JET RECORDING HEAD PROVIDED WITH THE SAME

(75) Inventor: Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 79 days.

(21) Appl. No.: 10/446,465

(22) Filed: May 27, 2003

(65) Prior Publication Data

US 2003/0222949 A1 Dec. 4, 2003

(30) Foreign Application Priority Data

May 28, 2002 (JP) ..... 2002-154351
Nov. 14, 2002 (JP) ..... 2002-330450

(51) Int. Cl.[7] ..... B41J 2/045
(52) U.S. Cl. ..... 347/71
(58) Field of Search ..... 29/25.35, 890.1; 347/65, 67–72; 118/300, 313–316; 156/60

(56) References Cited

U.S. PATENT DOCUMENTS 4,680,595 A 7/1987 Cruz-Uribe et al.
4,730,197 A 3/1988 Raman et al.
5,402,159 A 3/1995 Takahashi et al.
6,193,362 B1 2/2001 Nakata et al.
6,536,879 B2 * 3/2003 Ito et al. ..... 347/71
6,598,962 B2 * 7/2003 Okazawa et al. ..... 347/68
2002/0024568 A1 2/2002 Ito et al.
2002/0036678 A1 3/2002 Ito et al.

FOREIGN PATENT DOCUMENTS

| | | |
|---|---|---|
| JP | 55 109668 | 8/1980 |
| JP | 62-111758 | 5/1987 |
| JP | 62-124955 | 6/1987 |
| JP | 63-001551 | 1/1988 |
| JP | 4-341853 | 11/1992 |
| JP | 05-330069 | 12/1993 |
| JP | 10-119263 | 5/1998 |
| JP | 2002-096478 | 4/2002 |

* cited by examiner

*Primary Examiner*—K. Feggins
*Assistant Examiner*—Julian D. Huffman
(74) *Attorney, Agent, or Firm*—Reed Smith LLP

(57) ABSTRACT

A thin plate stacked structure is formed of a plurality of thin plates, which include at least one liquid flow passage thin plate provided with a liquid flow passage having a predetermined pattern formed on at least one surface, are stacked with an adhesive. The stacked structure further includes a release groove, an air release hole and an opening that is formed on the thin plate disposed at an outermost layer of the thin plate stack. The air release hole has a diameter which is larger than the width of the release groove and which is larger than the opening disposed on the outermost layer. Any excessive adhesive is accumulated in the air release hole, and it is possible to greatly decrease the amount of the adhesive outflowing to the outside of a cavity unit.

5 Claims, 18 Drawing Sheets

THIN PLATE STACKED STRUCTURE AND INK-JET RECORDING HEAD PROVIDED WITH THE SAME

BACKGROUND OF THE INVENTION

1. Field of the Invention

The present invention relates to a structure obtained by adhering and fixing, in a stacked form, a plurality of thin plate-shaped parts to be used, for example, for an ink-jet printer head and an electronic part.

2. Description of the Related Art

Examples of the ink-jet printer head of the on-demand type are described, for example, in Japanese Patent Application Laid-open No. 62-111758 corresponding to U.S. Pat. Nos. 4,680,595 and 4,730,197, Japanese Patent Application Laid-open No. 10-119263, and Japanese Patent Application Laid-open No. 2002-96478 corresponding to U.S. patent application Publication No. US2002/0036678 A1. As described in these patent documents, a structure is disclosed, in which a jetting pressure-generating member such as a driving piezoelectric element is secured, corresponding to each of portions of a plurality of pressure chambers, to a back surface of a cavity unit composed of a plurality of operating plates retained in an integrated manner by the aid of an adhesive in a stacked state.

The respective operating plates of the cavity unit include a nozzle plate which is provided with a plurality of nozzles, a base plate which is provided with pressure chambers corresponding to the respective nozzles, and a manifold plate which has ink chambers (manifolds) connected to an ink supply source and connected to the pressure chambers. Each of the plates is a thin metal plate having a thickness of about 200 $\mu$m or less.

Japanese Patent Application Laid-open No. 2002-96478 discloses the process in which the adhesive is applied to wide width surfaces of the base plate, the spacer plate, and the manifold plate of the cavity unit respectively to overlap and join the plates to one another. In this arrangement, release grooves, which are provided for the adhesive applied on the adhesion surface at positions disposed outer circumferentially as compared with ink flow passages such as the ink manifold, are formed on the wide width surface of each of the plates. Further, air release holes, which are provided to release the air in the plate thickness direction, are formed penetratingly through each of the plates opposed to the release grooves.

In the case of the patent document described above, as shown in FIG. 19, ink flow passages 202, through which the ink flows in the direction from the pressure chambers to the nozzles, are bored in arrays in the long side direction at substantially central portions with respect to the short sides of the plate 201 (illustrated plate is the spacer plate). Ink flow passages 203, through which the ink flows in the direction from the manifold chambers to the pressure chambers, are also bored in arrays in the long side direction at both left and right side portions with respect to the short sides of the plate 201. A plurality of release grooves 204 are formed in parallel to the long side direction of the plate 210 to surround the outer sides of the ink flow passages 202, 203. A large number of release grooves 205 are also formed in parallel to the short sides of each of the plates 201. Accordingly, the effect to release the adhesive is enhanced, and the adhesive is prevented from any inflow into the ink flow passages 202, 203.

However, the stack (cavity unit), which is constructed by laminating the respective plates, receives the pressure exerted from the actuator which is joined on the back surface side thereof, and the respective pressure chambers are expanded and contracted in the long side direction of the plate 201. The pressure chambers are formed in the base plate of the stack, and hence the base plate is also expanded and contracted. The base plate is adhered to the other plates in the stack. Therefore, when the base plate is expanded and contracted, the bending moment tends to be received so that the axis of the cavity unit (plate 201) in the long side direction is bent in the plate thickness direction. Therefore, when the large number of release grooves 205, which are parallel to the short side direction of the plate 201, are formed, the cross sections of the portions of the release grooves 205 parallel to the short side of the plate 201 are decreased. In particular, the plate thickness is thinned, and hence the bending rigidity is decreased with respect to the bending moment in the direction as described above. When the actuator is repeatedly operated, the following first problem has arisen due to the fatigue phenomenon caused by the stress concentration brought about by the stress exerted repeatedly on the portion of the groove parallel to the short side. That is, any crack appears in the plate 201 during the use for a long period of time, the adhesive surface between the respective plates is exfoliated, and any leakage of the ink is apt to occur.

The air release holes are provided in order that the air (bubble), which is caught up in the applied adhesive or by the overlay surfaces of the adjoining plates when the plurality of plates are stacked, pressed, and joined by the aid of the adhesive, is discharged to the outside of the cavity unit via the release grooves. Any excessive amount of the applied adhesive can be also discharged to the outside of the cavity unit via the release grooves and the air release holes during the process in which the overlay surfaces are mutually pressed. Further, the release grooves are not open to the outer circumferential edges of the respective plates. Therefore, when the layer of the applied adhesive is also used as the seal layer, it is possible to avoid the leakage of the ink to the outside of the cavity unit, for example, from the ink flow passages.

However, the following second problem has arisen. That is, when the viscosity of the adhesive is low, then the adhesive overflows to the outside from the through-holes of the plate disposed at the uppermost layer during the operation for pressing and joining the plates, and the adhesive consequently adheres to the pressing and joining apparatus. Therefore, in order to clean and treat the overflow adhesive, it is necessary to frequently perform the maintenance operation for conducting any extra cleaning operation. In other cases, extra time and labor are required, for example, such that the pressing and joining apparatus is laid with a sheet to prevent the adhesion of the adhesive when the pressing and joining operation is performed.

The first and second problems may also arise during the assembling of an electronic part constructed by staking a thin plate formed with a minute pattern onto another thin plate.

SUMMARY OF THE INVENTION

An object of the present invention is to provide a stacked and adhered (fixed) structure of thin plate-shaped parts in which the problems involved in the conventional technique as described above have been dissolved, and an ink-jet recording head provided with the same.

According to a first aspect of the present invention, there is provided a thin plate stacked structure comprising a plurality of thin plates which are stacked with an adhesive, the plurality of thin plates including at least one liquid flow passage thin plate provided with a liquid flow passage having a predetermined pattern formed on at least one surface, the stacked structure further comprising:

a release groove which is formed on the liquid flow passage thin plate and which releases the adhesive;

an air release hole which is bored through a thin plate stack stacked on the liquid flow passage thin plate, which is communicated with the release groove, and which penetrates in a stacking direction; and an opening which is formed on the thin plate disposed at an outermost layer of the thin plate stack and which allows the air release hole to be open to the outside, wherein:

the air release hole has a diameter which is larger than a width of the release groove and which is larger than the opening disposed at the outermost layer.

In the stack according to the present invention, the air release hole is formed to be larger than the width of the release groove, and the air release hole is formed to be larger than the opening disposed on the outermost layer. Accordingly, the cavity volume (capacity) of the air release hole is increased. Therefore, any excessive adhesive is accumulated in the air release hole, and it is possible to greatly decrease the amount of the adhesive outflowing to the outside of the cavity unit. Therefore, it is possible to suppress the adhesion of the adhesive to the pressing and joining apparatus, which would be otherwise caused by the outflow to the outside from the air release hole of the thin plate-shaped part disposed at the outermost layer. It is possible to avoid any extra cleaning operation which would be otherwise performed to clean and treat the outflow adhesive. Further, it is also possible to decrease the frequency of exchange of the installation of the sheet to the pressing and joining apparatus in order to avoid any adhesion of the adhesive thereto when the operation for pressing and joining the thin plates is performed.

According to a second aspect of the present invention, there is provided a thin plate stacked structure comprising a plurality of thin plates which are stacked with an adhesive, the plurality of thin plates including at least one liquid flow passage thin plate provided with a liquid flow passage having a predetermined pattern formed on at least one surface, the stacked structure further comprising:

a release groove which is formed on the liquid flow passage thin plate and which releases the adhesive;

an air release hole which is bored through a thin plate stack stacked on the liquid flow passage thin plate, which is communicated with the release groove, and which penetrates in a stacking direction; and an opening which is formed on the thin plate disposed at an outermost layer of the thin plate stack and which allows the air release hole to be open to the outside, wherein:

at least one portion of the release groove, which is disposed in the vicinity of the air release hole, has a width which is wider than those of other portions of the release groove to form an adhesive pool.

In the stacked structure according to the second aspect, any excessive adhesive, which appears on the intermediate layer during the adhesion with the adhesive, is accumulated in the adhesive pool having an enlarged volume. Accordingly, it is possible to greatly decrease the amount of the adhesive outflowing to the outside of the stacked structure. Therefore, it is possible to avoid the cleaning operation for the outflow or protruding adhesive.

In the stacked structure according to each of the first and second aspects of the present invention, the release groove may be formed outside the liquid flow passage on the liquid flow passage thin plate. Further, a hole for defining the air release hole may be formed through each of the thin plates for constructing the stack. Further, the liquid flow passage having the predetermined pattern may be composed of a plurality of through-holes arranged in a certain direction.

According to another aspect of the present invention, there is also provided an ink-jet recording head comprising a cavity plate which is composed of the stacked structure according to the first or second aspect of the present invention, and an actuator, wherein the cavity plate has a plurality of nozzles, and the liquid flow passage is an ink flow passage for allowing an ink to pass from an ink supply source to the nozzles. A large amount of the adhesive does not protrude from the uppermost layer during the operation for stacking the thin plates of the ink-jet recording head. Therefore, the production is carried out with ease, and the cost is low.

The holes, which are formed through the respective thin plates for constructing the stack, may be arranged coaxially or in an offset manner in the stacking direction. The adhesive, which is applied to the overlay surface of the thin plate, is moved to the adjoining thin plate during the pressing and joining operation from the release groove (via the enlarged adhesive pool) via the air release hole penetrating in the vertical direction of each of the thin plates. When the holes, which are formed through the respective thin plates, are arranged coaxially or in the offset manner in the stacking direction, the adhesive is moved in a zigzag manner. Accordingly, the adhesive having a small viscosity hardly arrives at the outermost layer. Therefore, it is possible to decrease the amount of protrusion of the adhesive to the outside of the stack.

According to a third aspect of the present invention, there is provided a thin plate stacked structure comprising a plurality of thin plates which are stacked with an adhesive, the plurality of thin plates including at least one pattern-formed thin plate provided with a hole or a recess having a predetermined pattern formed on at least one surface to extend in a predetermined direction; the stacked structure further comprising a release groove which is formed on the at least one surface of the pattern-formed thin plate and which releases the adhesive, wherein the release groove includes a groove which extends while being inclined with respect to the predetermined direction. In the stacked structure according to the present invention, even when the bending moment acts in a predetermined direction, for example, in a direction perpendicular to the long side direction of the thin plate to bend each of the thin plates in the plate thickness direction, the rigidity is scarcely decreased in relation to the bending moment, because the portion of the release groove (portion having a small plate thickness) appears only a part of a cross section perpendicular to the predetermined direction as viewed in the cross section perpendicular to the predetermined direction. Therefore, the stacked structure having a high strength is provided even when the thickness is thin. In the stacked structure according to the present invention, the release groove may be formed to circumscribe at least a part of the predetermined pattern. The recess or the hole may be a flow passage for a liquid including, for example, an ink.

In the stacked structure according to the third aspect of the present invention, the release groove may further include a groove which extends in the predetermined direction and which is communicated with the groove which extends while being inclined with respect to the predetermined direction. Any excessive adhesive, which is applied to the surface of the thin plate, can be released via the two types of the release grooves, while the rigidity in relation to the bending moment can be maintained to be high as well.

An air release hole, which is communicated with the release groove and which penetrates in a thickness direction of the thin plate, may be bored on the at least one surface of the pattern-formed thin plate. The air, which is caught up in the adhesive or by the overlay surface (wide width surface) of the thin plate, behaves as bubbles to move together with the adhesive existing on the overlay surface, in the release groove in the lateral direction, and in the air release hole in the vertical direction, and thus the air is successfully discharged to the outside of the thin plate. As a result, it is possible to form stable adhesive/seal layers by means of the layers of the adhesive formed in a layered form on the overlay surfaces (wide width surfaces) of the adjoining thin plates. Further, the air release hole is not open at the end of each of the thin plates unlike the conventional technique. Therefore, the liquid leakage is reliably avoided, which would be otherwise caused at such portions. In the stacked structure according to the third aspect of the present invention, the release groove may be formed in a meandering form as viewed in plan view.

According to still another aspect, there is provided an ink-jet recording head comprising a cavity plate which is composed of the stacked structure of the present invention according to the third aspect, and an actuator, wherein the cavity plate has a plurality of nozzles, and the hole or the recess is an ink flow passage for allowing an ink to pass from an ink supply source to the nozzles. Therefore, it is possible to reliably prevent such an accident that the ink is leaked to the outside from the ink flow passage formed in the cavity plate for the ink-jet printer head, and thus it is possible to secure the performance necessary for the ink-jet printer head. When the cavity plate includes a base plate having a plurality of pressure chambers arranged in the predetermined direction, the rigidity in relation to the bending moment is decreased due to the array of the plurality of pressure chambers. However, when the groove, which extends while being inclined with respect to the predetermined direction, is formed to traverse at least two of the pressure chambers, it is possible to minimize the decrease of the rigidity and the flexure of the base plate caused by the presence of the groove.

According to a fourth aspect of the present invention, there is provided a thin plate stacked structure comprising a plurality of thin plates which are stacked and adhered with an adhesive, the plurality of thin plates including at least one thin plate provided with a liquid flow passage having a predetermined pattern formed on at least one surface of the at least one thin plate, wherein:

a plurality of anchor holes are bored penetratingly in a thickness direction of the at least one thin plate.

In the thin plate stacked structure according to the fourth aspect, the anchor holes of one plate are not connected to one another in the in-plane direction of the plate. Accordingly, the rigidity against the bending moment is not greatly decreased (lowered) locally. It is possible to obtain the stacked and adhered structure of the thin plate-shaped parts having the high degree of strength even though the thickness is thin. Further, a part of the adhesive disposed between the stacked plates enters the anchor holes, and the adhesive is adhered to at least portions of the circumferential surfaces of the anchor holes so that the force is allowed to act to fasten the both plate (referred to as "anchoring effect"). Therefore, it is possible to effect the powerful joining function as compared with the joining force brought about by the adhesive based on only the areas of the stacking surfaces at which the plates are opposed to one another.

In the thin plate stacked structure according to the fourth aspect of the present invention, the anchor holes may be disposed in a zigzag arrangement as viewed in plan view of a plate.

In the thin plate stacked structure according to the fourth aspect of the present invention, the at least one thin plate is adjoining stacked thin plates each of which has the anchor holes, the anchor holes may be arranged so that portions of the anchor holes are communicated with each other in a stacking direction at adjoining stacked portions of the thin plates.

DESCRIPTION OF THE PREFERRED EMBODIMENTS

First Embodiment

Figure 1:
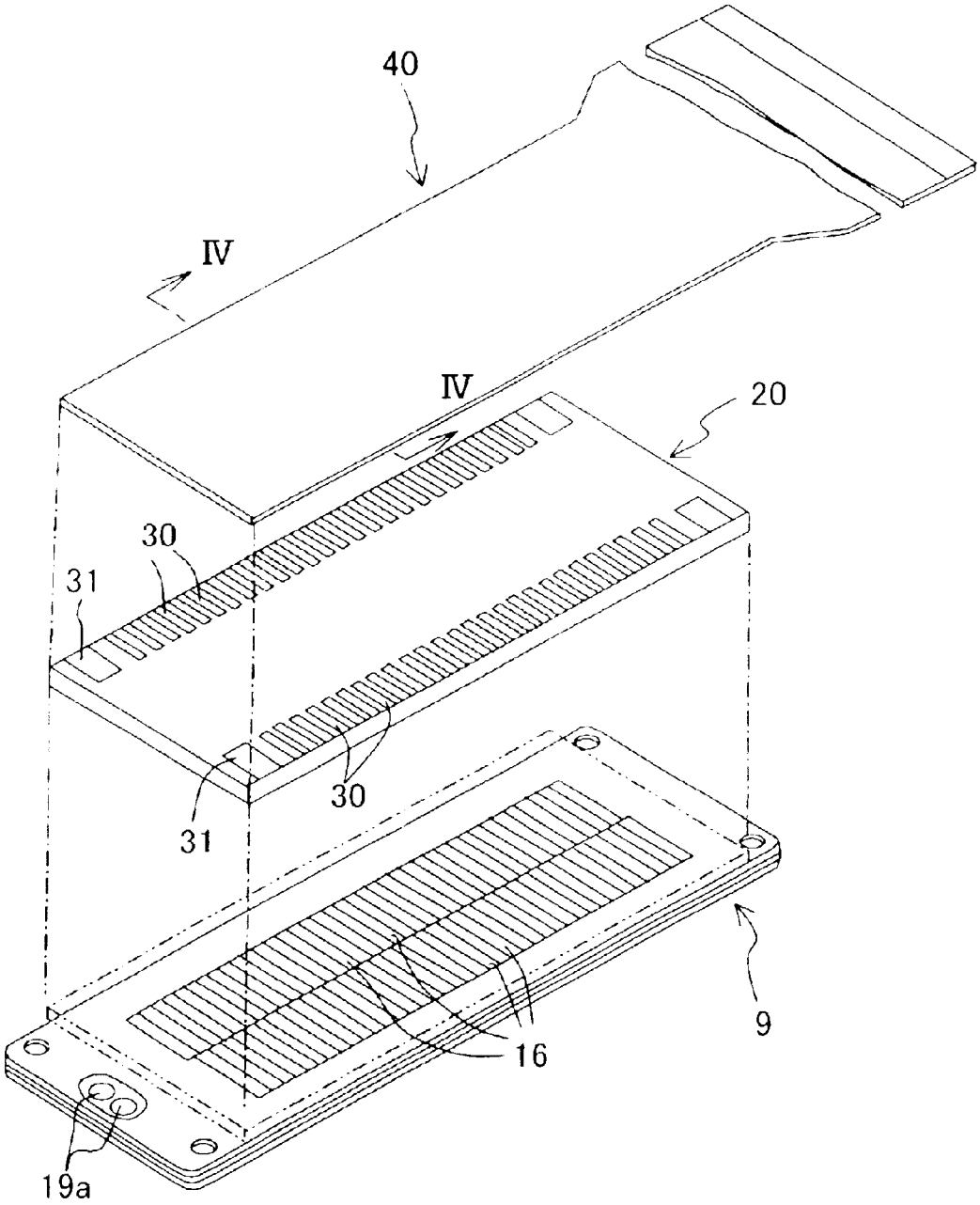
FIG. 1 shows an exploded perspective view illustrating a piezoelectric ink-jet printer head according to an embodiment of the present invention.
Figure 2:
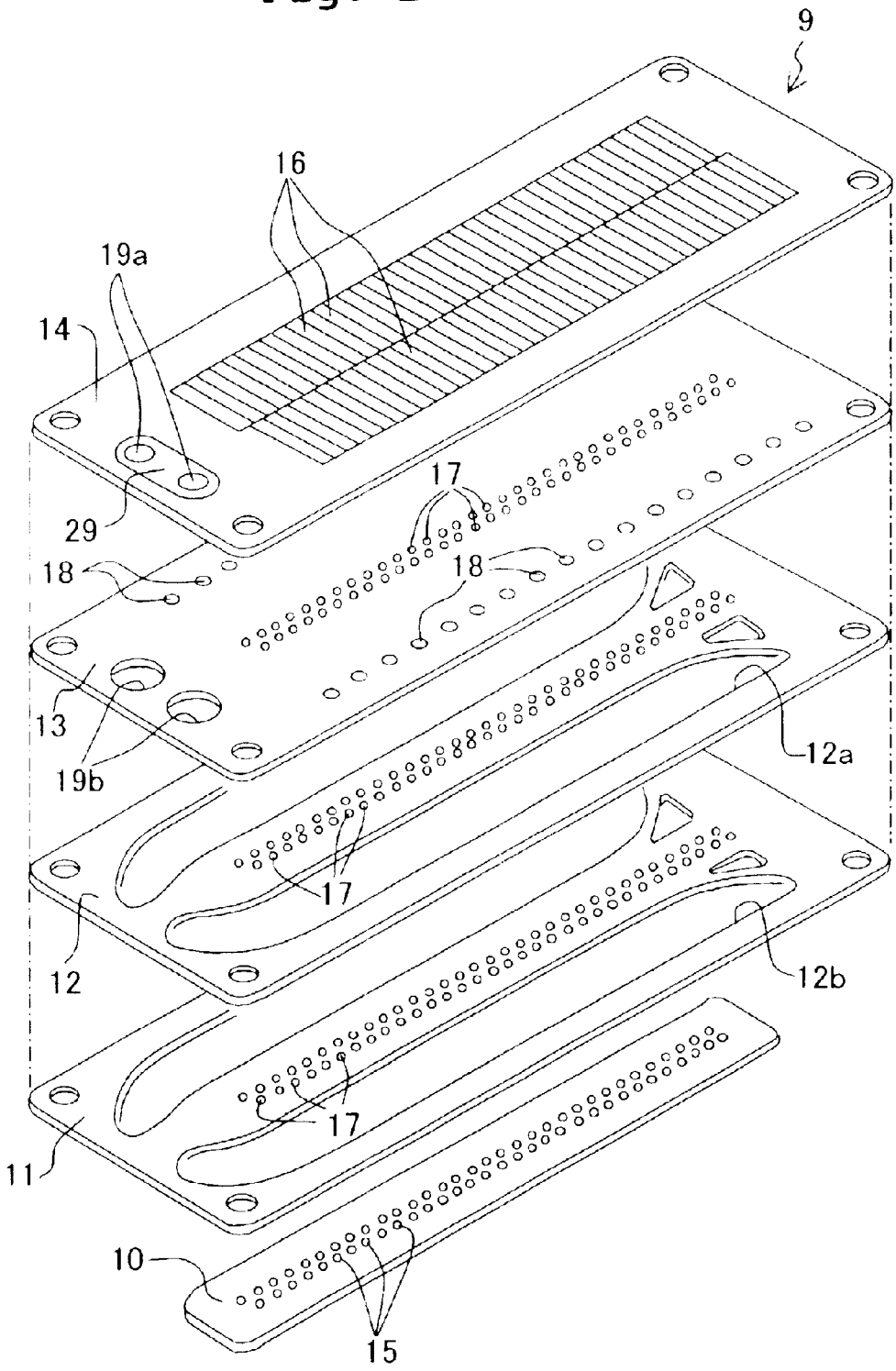
FIG. 2 shows an exploded perspective view illustrating a cavity unit.

An embodiment of the present invention will be explained below with reference to the drawings. FIGS. 1 to 7 show a piezoelectric ink-jet printer head according to a first embodiment of the present invention. In FIG. 1, a flexible flat cable 40 is overlapped and joined with an adhesive to effect the connection to an external apparatus on an upper surface of a plate type piezoelectric actuator 20 which is joined to a cavity unit 9 made of metal plates. The ink is jetted downwardly from nozzles 15 which are open on the lower surface side of the lowermost layer of the cavity unit 9.

Figure 3:
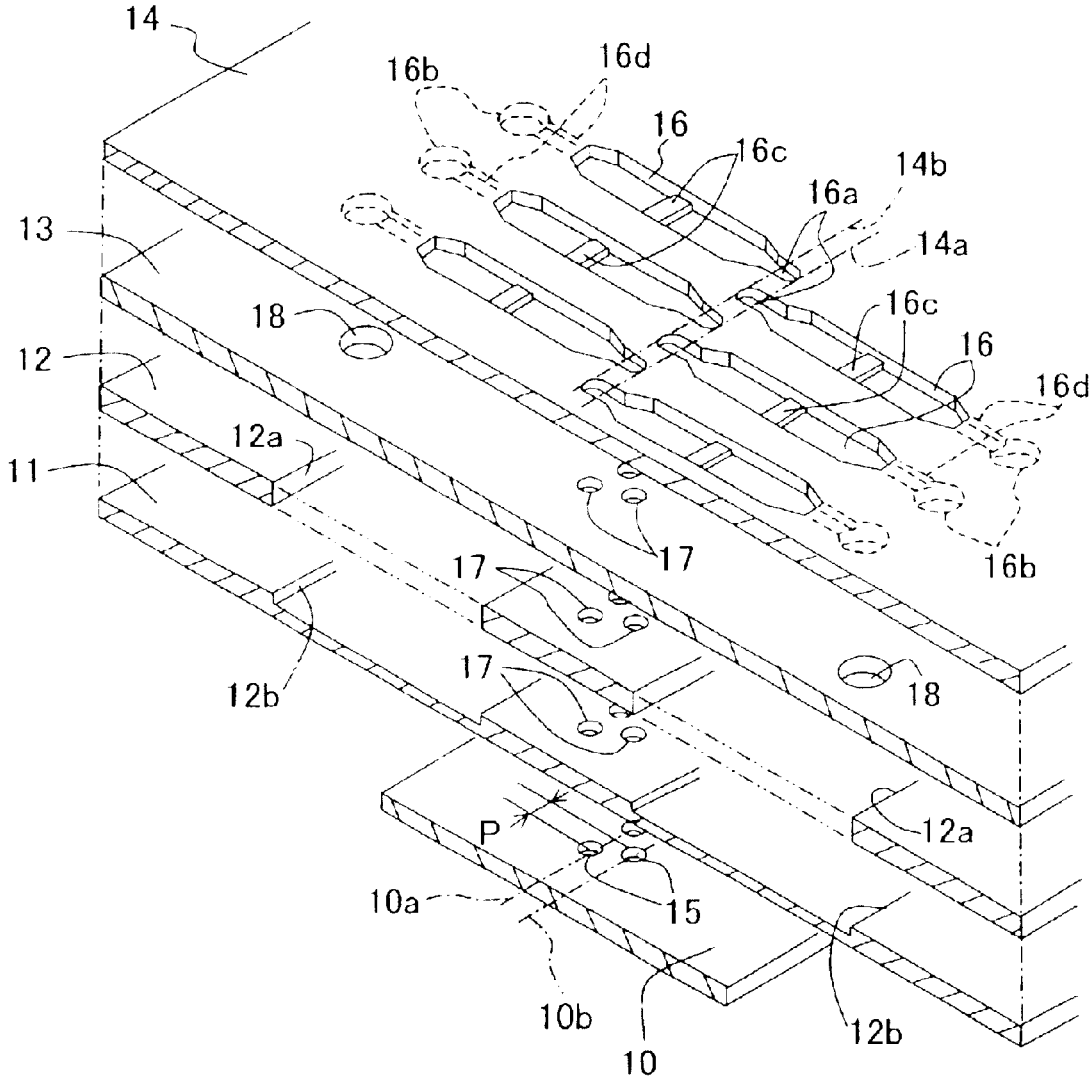
FIG. 3 shows a magnified exploded perspective view illustrating portions of the cavity unit.
Figure 4:
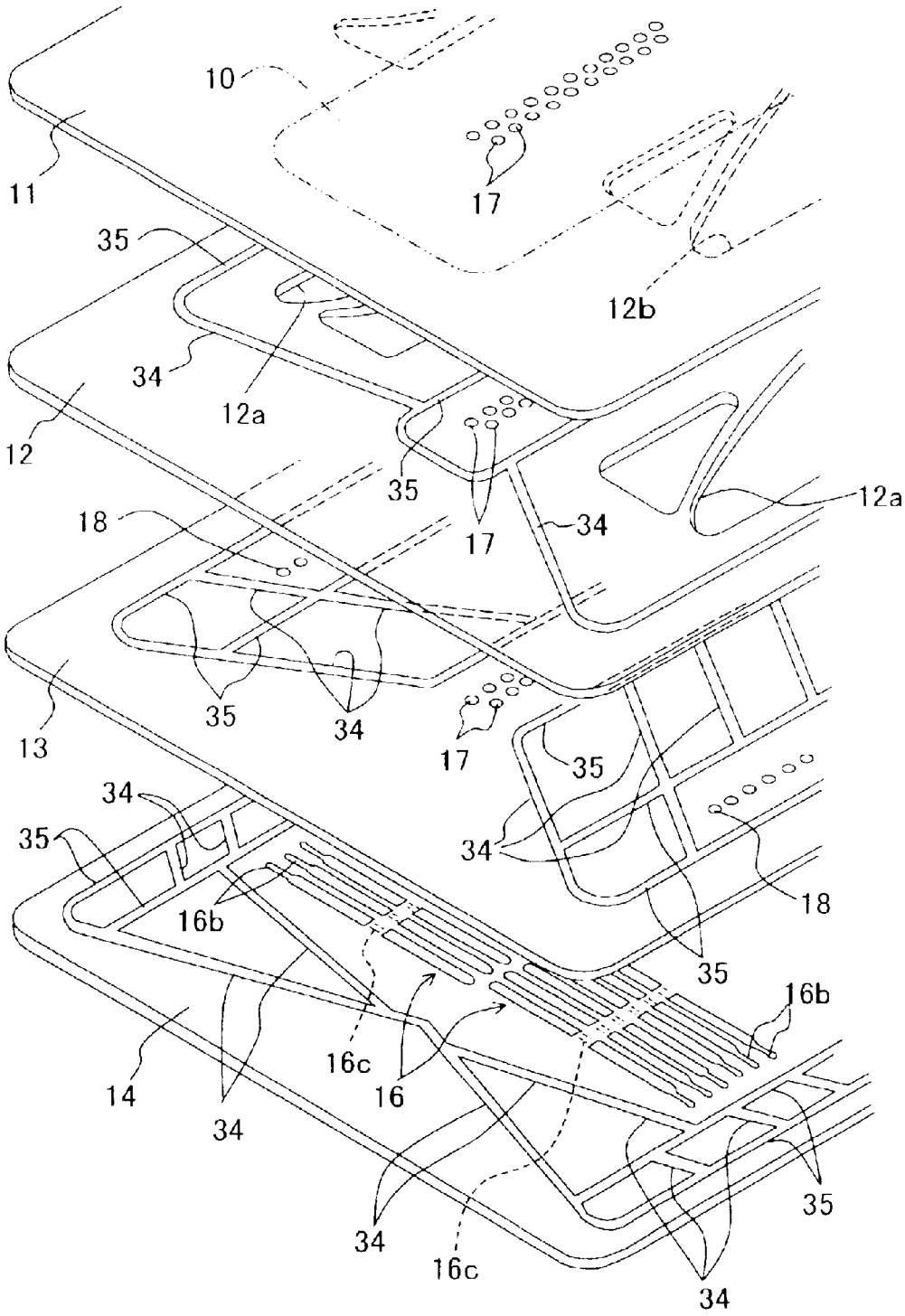
FIG. 4 shows a magnified exploded perspective view illustrating portions of the cavity unit which is arranged while directing nozzles upwardly.

The cavity unit 9 is constructed as shown in FIGS. 2 to 6. That is, the cavity unit 9 has such a structure that five thin plates, i.e., a nozzle plate 10, two manifold plates 11, 12, a spacer plate 13, and a base plate 14 are overlapped, joined, and stacked with an adhesive respectively. In this embodiment, each of the plates 11, 12, 13, 14 is made of a 42% nickel alloy steel plate having a thickness of about 50 μm to 150 μm except for the nozzle plate 10 made of a synthetic resin. The nozzles 15 for jetting the ink, each of which has a minute diameter (about 25 μm in this embodiment), are provided on the nozzle plate 10 in two arrays of the zigzag arrangement in the first direction (long side direction) of the nozzle plate 10. That is, the large number of nozzles 15 are bored in the zigzag arrangement at spacing distances of minute pitches P along two parallel reference lines 10*a*, 10*b* which extend in the first direction of the nozzle plate 10. Manifolds 12*a*, 12*b*, which serve as fluid passages for supplying the ink to respective pressure chambers 16 as described later on after storing the ink supplied from an external ink supply source, are formed as bores of the two manifold plates 11, 12 so that the manifolds 12*a*, 12*b* extend along the both sides of the arrays of the nozzles 15. However, the manifolds 12*b*, which are formed on the manifold plate 11 disposed on the lower side opposed to the nozzle plate 10, are formed as recesses so that the manifolds 12*b* are open on only the upper side of the manifold plate 12 (see FIGS. 3 and 4). The manifolds 12*a*, 12*b* are structured such that they are tightly closed by stacking the spacer plate 13 on the manifold plate 12 disposed on the upper side. FIG. 4 shows, with partial cutout, a perspective view illustrating parts of the nozzle plate 10, the manifold plates 11, 12, the spacer plate 13, and the base plate 14 respectively in a state in which back surfaces (lower surfaces) of portions corresponding to the right ends as shown in FIG. 3 are directed upwardly.

A large number of pressure chambers 16, each of which has a thin width and which extend in the second direction (short side direction) perpendicular to the center line extending along the long side (in the first direction described above), are bored through the base plate 14. Longitudinal reference lines 14*a*, 14*b* are established to extend in parallel on the both left and right sides with the center line intervening therebetween. On this assumption, tip flow passages 16*a* of the pressure chambers 16, which are disposed on the left side of the center line, are positioned on the longitudinal reference line 14*a* disposed on the right side, while tip flow passages 16*a* of the pressure chambers 16, which are disposed on the right side of the longitudinal center line, are positioned on the longitudinal reference line 14*b* disposed on the left side. Further, the tip flow passages 16*a* of the left and right pressure chambers 16 are alternately arranged. Therefore, the pressure chambers 16, which are disposed on the both left and right sides, are arranged alternately every other one to extend in the mutually opposite directions.

The tip flow passages 16*a* of the respective pressure chambers 16 are communicated with the nozzles 15 disposed in the zigzag arrangement on the nozzle plate 10 via communication holes 17, 17, 17 having minute diameters to serve as ink flow passages (liquid passages) which are bored in the zigzag arrangement as well through the spacer plate 13 and the both manifold plates 11, 12. On the other hand, second ends of the respective pressure chambers 16 are connected to second end flow passages 16*b* having large diameters via slender throttle sections 16*d* which serve as ink flow passages having small cross-sectional areas. The second end flow passages 16*b* are communicated with the manifolds 12*a*, 12*b* of the both manifold plates 11, 12 via through-holes 18 which serve as liquid passages bored through both left and right side portions of the spacer plate 13. As shown in FIGS. 3 and 4, the second end flow passages 16*b* and the slender throttle sections 16*d* are formed as recesses so that they are open on only the lower surface side of the base plate 14. The diameter of the second end flow passage 16*b* is formed to be substantially the same as the diameter of the through-hole 18. The cross section of the throttle section 16*d* is smaller than that of the pressure chamber 16 in order to restrict the flow of the ink directed from the pressure chamber 16 to the manifold 12*a*, 12*b* when the piezoelectric actuator 20 is driven.

Interconnecting sections 16*c*, which have thicknesses about the half of the plate thickness of the base plate 14, are provided at intermediate portions of the respective pressure chambers 16 in the longitudinal direction. Accordingly, the side walls of the large number of juxtaposed pressure chambers 16 are prevented from the decrease in rigidity.

Supply holes 19*b*, which are bored through first end portions of the spacer plate 13, are communicated with the manifolds 12*a*. Further, the supply holes 19*b* are also communicated with supply holes 19*a* which are bored through first end portions of the base plate 14 disposed at the uppermost layer. A filter 29 is stretched on the upper surfaces of the supply holes 19*a* in order to remove the dust contained in the ink to be supplied from an ink tank provided thereover.

Figure 5:
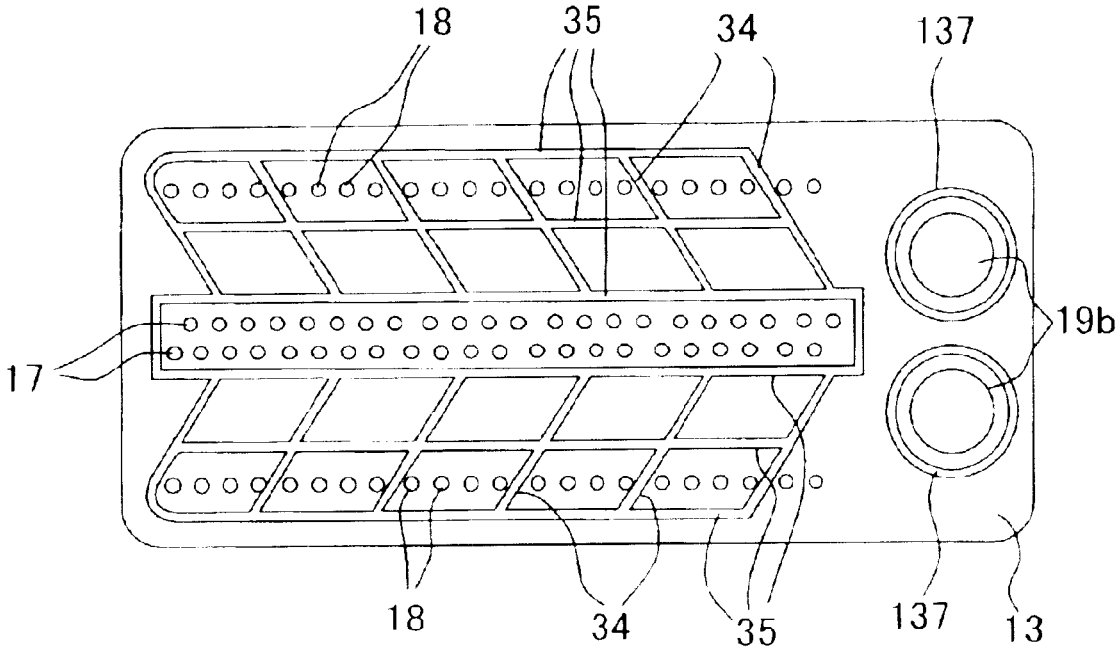
FIG. 5 shows a plan view illustrating a spacer plate.

The situation, in which the plates 11, 12, 13, 14 are stacked, is shown in FIGS. 4 and 5. In this case, a plurality of release grooves 34, which are provided to release the adhesive 39, are formed as recesses to extend in directions not perpendicular to the long side direction of the plates at portions disposed outside the outer circumferences of the pressure chambers 16, the communication passages 17, the through-holes 18, and the supply holes 19*a*, 19*b* to serve as the liquid flow passages as described above at least on first surfaces (wide width surfaces) of the respective plates. Another type of release grooves 35 are formed along the long sides. The both release grooves 34, 35 are communicated with each other at their connecting portions. Further, the release grooves 34, 35 are formed to extend in mutually inclined directions.

Figure 8:
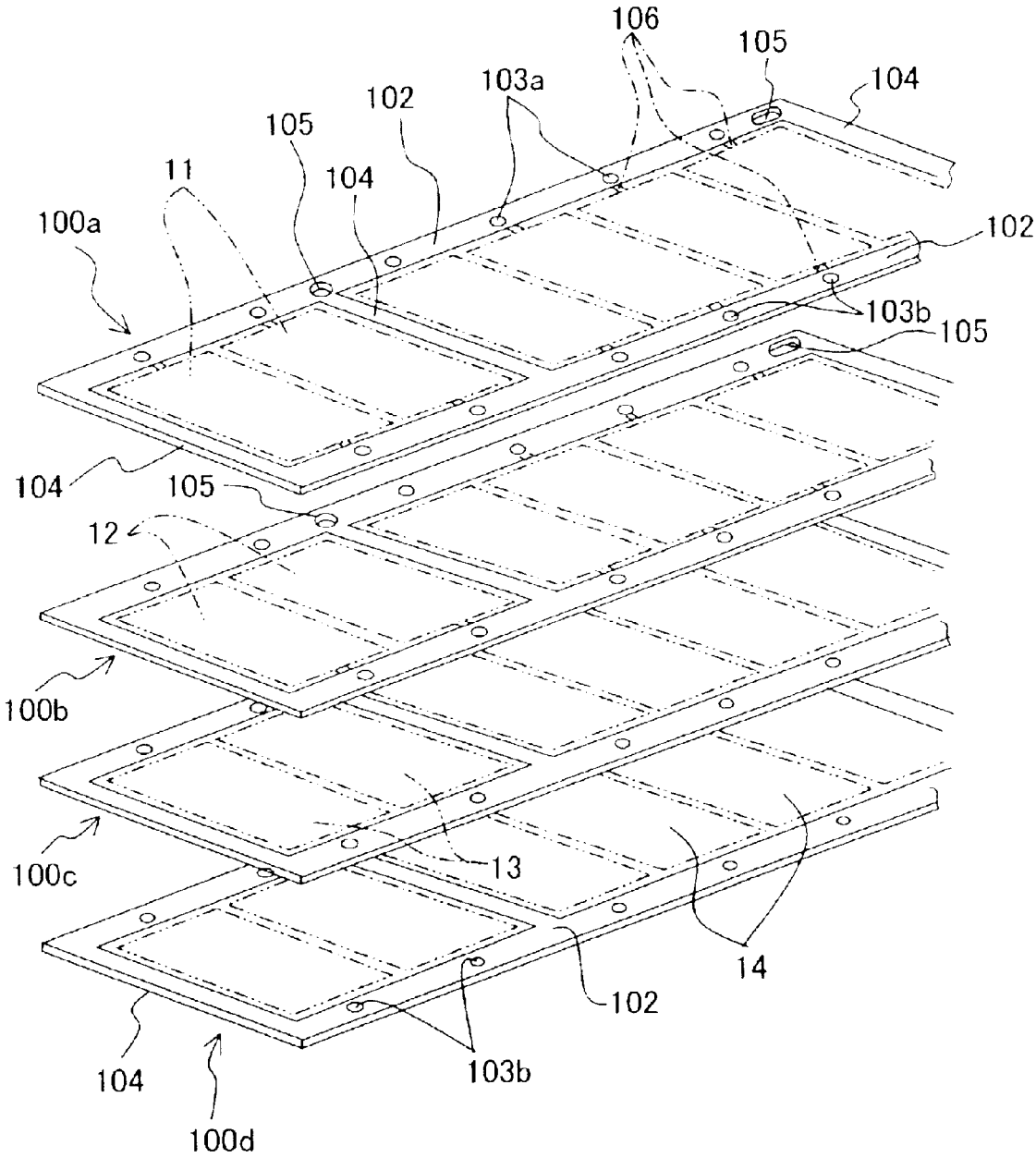
FIG. 8 shows a perspective view illustrating the stacking of lead frames according to the present invention.

Next, an explanation will be made about a method for assembling the cavity unit 9. As shown in FIG. 8, four lead frames 100*a* to 100*d* are stacked, adhered, and fixed. The manifold plates 11, 12, the spacer plates 13, and the base plates 14, which are the thin plate-shaped parts formed with predetermined patterns, are arranged and juxtaposed to one another at constant spacing distances on the respective lead frames 100*a* to 100*d*. That is, the lead frame 100*d*, which is disposed at the lowermost layer, is formed so that the base plates 14 as described in the embodiment are arranged at the constant spacing distances. Left and right slender frame bars 102, 102 are connected to one another by tie bars 104 disposed at appropriate spacing distances. Similarly, the spacer plates 13 are formed at the same spacing distances as those described above on the lead frame 100*c* disposed at the second layer from the bottom. The manifold plates 12 are formed at the same spacing distances as those described above on the lead frame 100*b* disposed at the third layer from the bottom. The second manifold plates 11 are formed at the same spacing distances as those described above on the lead frame 100*a* disposed at the uppermost layer. Feeding holes 103*a*, 103*b* and positioning holes 105 are appropriately formed at constant spacing distances through the frame bars 102 of the respective lead frames 100*a* to 100*d*. The respective plates 11, 12, 13, 14 are connected to the frame bars 102 by the aid of interconnecting tabs 106 having minute widths.

When the lead frames are stacked, as shown in FIG. 4, the lead frames are stacked so that the parts are disposed upside down as compared with the state of use of the cavity unit 9 (state in which the ink nozzles are open on the lower surface side). In this situation, as shown in FIG. 4, they are arranged so that the release grooves 34, 35 for the adhesive, which are formed on the respective first surfaces of the base plate 14 disposed at the lowermost layer, the spacer plate 13 disposed at the second layer from the bottom, and the manifold plate 12, are directed upwardly. FIG. 5 shows a plan view illustrating the arrangement of the release grooves 34, 35 formed on the spacer plate 13, depicting an example in which release grooves 137 for the adhesive having annular configurations as viewed in the plan view are formed as recesses at the outer circumferences of the supply holes 19*b*.

Air release holes 36, 36, 36 are bored at upper and lower identical positions of the release grooves 34, 35 and the flat surfaces of the respective plates opposed thereto so that the air release holes 36, 36, 36 are communicated with the release grooves and the air release holes 36, 36, 36 penetrate through the plate thicknesses of the respective plates 13, 12, 11 to make the communication in the vertical direction. Further, at least one of the air release holes 36 formed for the manifold plate 11 disposed at the uppermost layer or the base plate 14 disposed at the lowermost layer is open to the outside. Preferably, the air release hole 36, which is formed for the base plate 14 disposed at the lowermost layer, is a recess which has about a half thickness of the plate thickness and which is not communicated with the lower surface side (see FIGS. 7A and 7B).

The adhesive 39 is previously applied to plate-stacking surfaces of the lead frames 100*a* to 100*d*. One of the methods for applying the adhesive 39 is as follows. That is, the adhesive 39 is previously applied in thin thickness onto a flat surface of an unillustrated jig, and the plates-stacking surface of each of the lead frames 100*a* to 100*d* is placed and overlaid on the applied surface. Accordingly, it is possible to transfer the adhesive 39, for example, to the flat land surface other than the recesses of, for example, the release grooves 34, 35, the pressure chambers 16, the second end flow passages 16*b*, the throttle sections 16*d*, and the air release holes 36 of the base plate 14. The adhesive 39 may be transferred by making the pressing abutment of the plate-stacking surface against a roller surface to which the adhesive 39 has been applied.

Subsequently, pins are inserted into the positioning holes 105 to adhere and fix the lead frames 100*a* to 100*d* by allowing the pressing force or the interposing force to act on the lead frame 100*d* disposed at the lowermost layer and the lead frame 100*a* disposed at the uppermost layer.

Figure 7A:
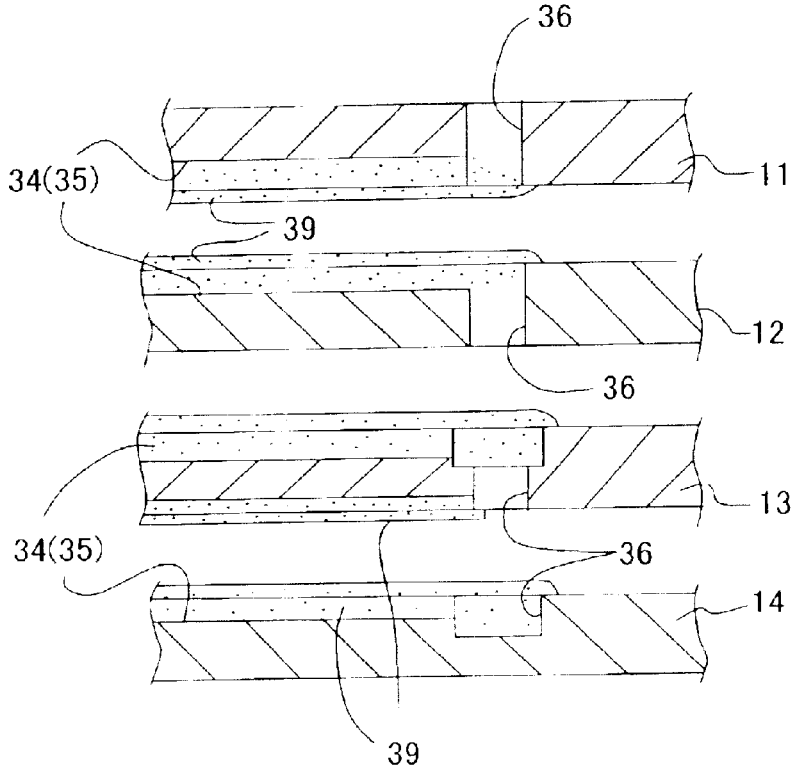
FIG. 7A shows a sectional view illustrating, for example, release grooves and air release holes depicting a state of application of an adhesive prior to the stacking.
Figure 7B:
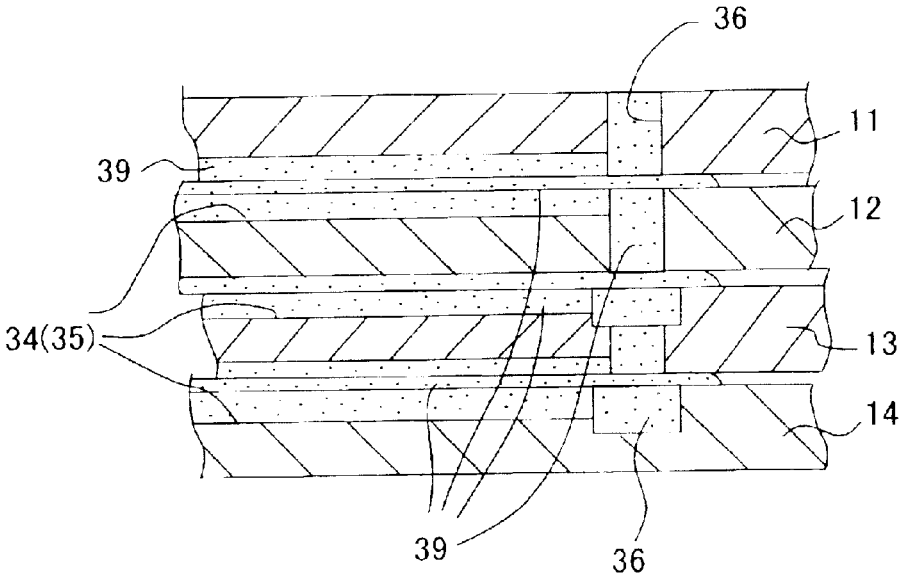
FIG. 7B shows a sectional view illustrating a stacked and adhered state of the respective plates.

When the plurality of lead frames, to which the adhesive 39 has been transferred, are pressed as described above to adhere and fix the wide width surfaces of the respective plates 11, 12, 13, 14, any excessive adhesive 39 inflows into the release grooves 34, 35. Subsequently, as shown in FIG. 7B, the air release holes 36 are filled with the excessive adhesive 39. During this process, the air, which is caught up in the adhesive 39 and the overlay surfaces (wide width surfaces) of the adjoining plates 11, 12, 13, 14, behaves as bubbles which are moved together with the adhesive 39 in the release grooves 34, 35 in the lateral direction and the air release holes 36 in the vertical direction and which are discharged to the outside of the plates. As a result, it is possible to form stable adhesive/seal layers by means of the adhesive 39 formed in layered configurations without containing any bubble on the overlay surfaces (wide width surfaces) of the adjoining plates 11, 12, 13, 14.

The interconnecting tabs 106 are cut from the lead frames 100*a* to 100*d* having been adhered and fixed as described above, and the integrated cavity units 9 are removed. Each of the cavity units 9 is constructed as follows. That is, the ink inflows into the manifolds 12*a*, 12*b* from the supply holes 19*a*, 19*b* bored through the first ends of the base plate 14 and the spacer plate 13. The ink passes from the manifolds 12*a* via the respective through-holes 18, and the ink is distributed into the respective pressure chambers 16. After that, the ink passes from the respective pressure chambers 16 via the communication holes 17, 17, 17, and the ink arrives at the nozzles 15 corresponding to the pressure chambers 16.

Figure 6:
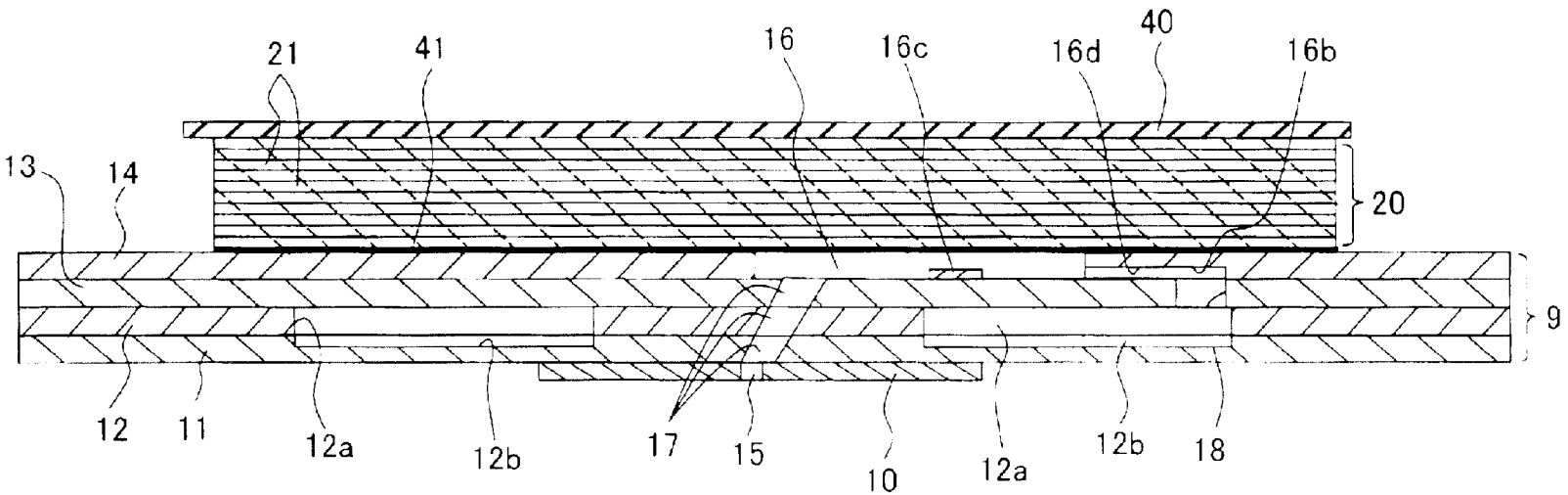
FIG. 6 shows a magnified sectional view illustrating the piezoelectric ink-jet printer head taken along a line VI—VI indicated by arrows shown in FIG. 1.

On the other hand, as shown in FIGS. 1 and 6, the piezoelectric actuator 20 has such a structure that a plurality of piezoelectric sheets 21 are stacked. In the same manner as disclosed in Japanese Patent Application Laid-open No. 4-341853 corresponding to U.S. Pat. No. 5,402,159, thin width individual electrodes (not shown), which are disposed at respective positions corresponding to the respective pressure chambers 16 of the cavity unit 9, are formed in arrays in the first direction (long side direction) on the upper surfaces (wide width surfaces) of the piezoelectric sheet disposed at the lowermost level and the piezoelectric sheets having odd numbers as counted upwardly therefrom, of the respective piezoelectric sheets 21 each having a thickness of about 30 $\mu$m. The respective individual electrodes extend to positions in the vicinity of the end edges of the long sides of the respective piezoelectric sheets in the second direction perpendicular to the first direction. Common electrodes (not shown), which are common to the plurality of pressure chambers 16, are formed on the upper surfaces (wide width surfaces) of the piezoelectric sheets disposed at the even number levels as counted from the bottom. Those provided on the upper surface of a top sheet disposed at the uppermost level along the end edges of the long sides thereof are surface electrodes 30 which are electrically connected to the respective individual electrodes, and surface electrodes 31 which are electrically connected to the common electrodes (see FIG. 1).

An adhesive sheet 41, which is composed of an ink-impermeable synthetic resin material to serve as an adhesive layer, is previously stuck to the entire lower surface (wide width surface opposed to the pressure chambers 16) of the plate type piezoelectric actuator 20 constructed as described above. Subsequently, the piezoelectric actuator 20 is adhered and fixed to the cavity unit 9 while allowing the respective individual electrodes to correspond to the respective pressure chambers 16 of the cavity unit 9 respectively (see FIG. 6). The flexible flat cable 40 is overlaid and pressed onto the upper surface of the piezoelectric actuator 20. Accordingly, various wiring patterns (not shown) of the flexible flat cable 40 are electrically connected to the respective surface electrodes 30, 31.

In this arrangement, when the voltage is applied between the common electrode and an arbitrary individual electrode of the respective individual electrodes of the piezoelectric actuator 20, the strain in the stacking direction, which is based on the piezoelectric effect, is generated at the portion of the individual electrode of the piezoelectric sheet 21 to which the voltage is applied as described above. The internal volume of the pressure chamber 16 corresponding to each of the individual electrodes is reduced by the strain. Accordingly, the ink contained in the pressure chamber 16 is jetted in a liquid droplet form from the nozzle 15 to perform the predetermined printing (see FIG. 6).

The release grooves 34, 35 for the adhesive of the respective plates 11 to 14 of the cavity unit 9 extend in the directions which are not perpendicular to the long sides of the respective plates. Therefore, even when any bending moment acts on the cavity unit 9 in the direction perpendicular to the long side direction to bend the respective plates in the plate thickness direction by the pressing force exerted by the actuator 20, the rigidity against the bending moment is not greatly decreased locally, because the portions corresponding to the release grooves 34, 35 (portions having small plate thicknesses) appear only parts of the short sides of the respective plates as viewed in cross sections taken in parallel to the short sides of the respective plates. Therefore, it is possible to obtain the cavity unit 9 having a large strength even though it has a thin thickness. In particular, when the release groove 34 is formed to traverse the plurality of pressure chambers 16 arranged in the base plate 14, then it is possible to decrease the flexure of the base plate 14 which would be otherwise caused by the presence of the plurality of pressure chambers 16, and it is possible to avoid the decrease of the rigidity which would be otherwise caused by the bending moment described above, as compared with a case in which the release grooves 34 are formed in the short side direction.

Second Embodiment

Figure 9:
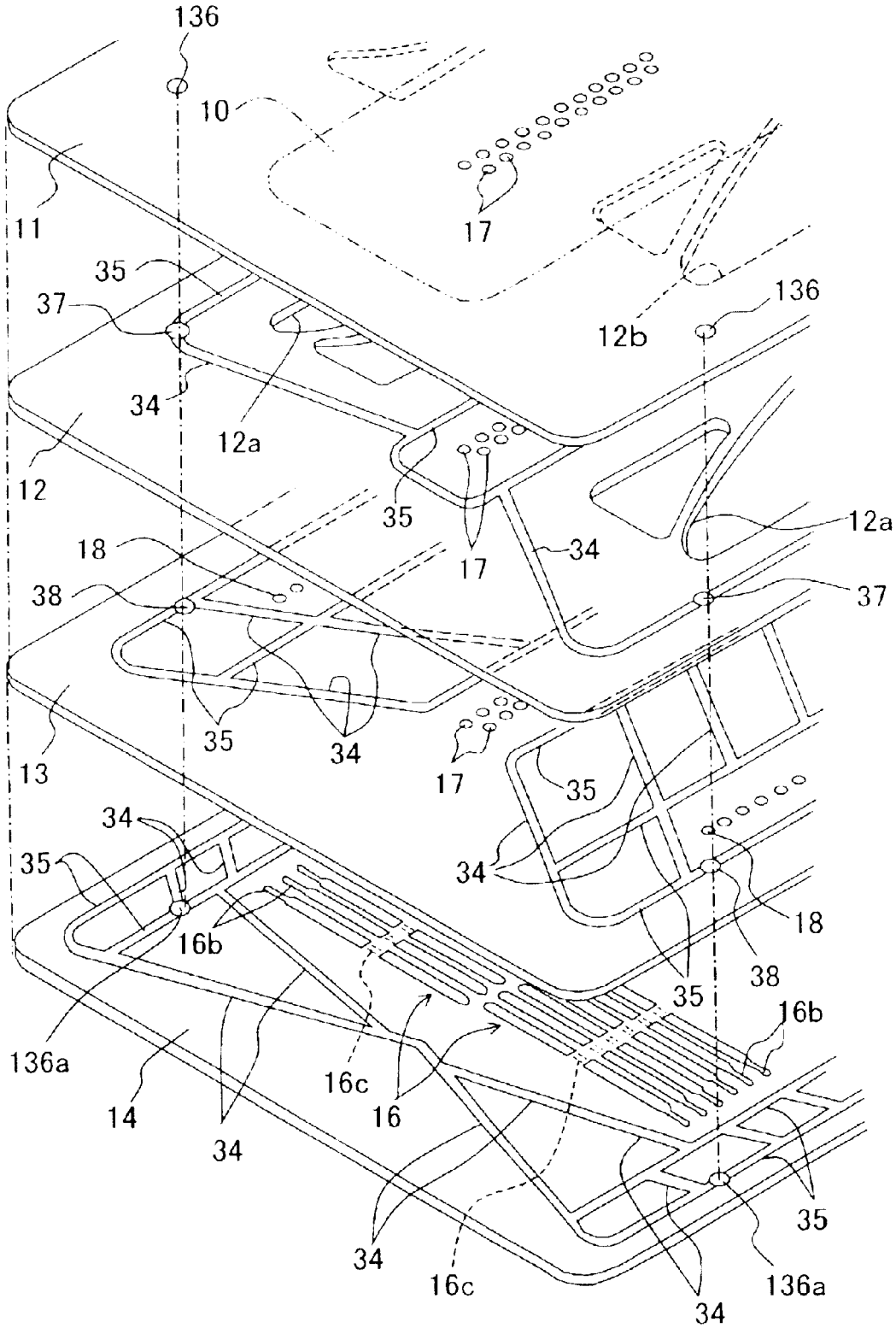
FIG. 9 shows an exploded perspective view illustrating the release grooves and the air release holes of the respective plates which are arranged while directing nozzles upwardly.
Figure 10A:
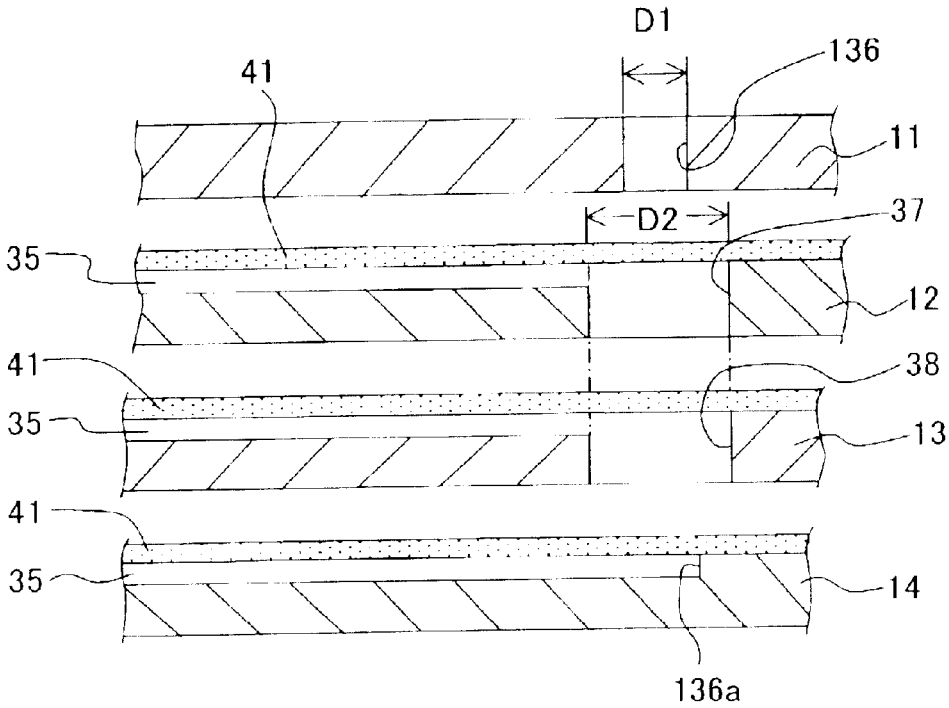
FIG. 10A shows a sectional view illustrating, for example, release grooves and air release holes depicting a state of application of an adhesive prior to the stacking.
Figure 10B:
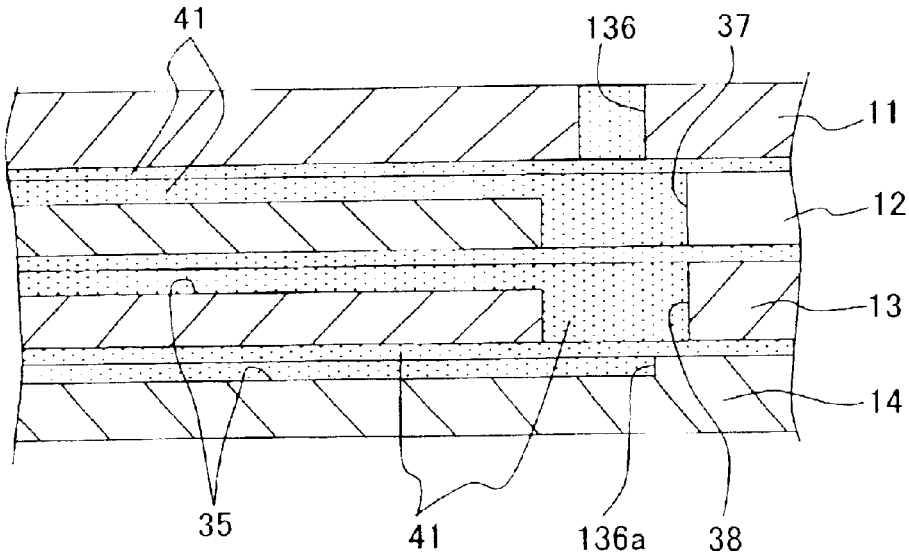
FIG. 10B shows a sectional view illustrating a stacked and adhered state of the respective plates.

A second embodiment of the piezoelectric ink-jet printer head according to the present invention will be explained below. The head and a method for producing the same are approximately the same as those described in the first embodiment except that the air release hole and the release groove of the cavity unit differ in structure as explained below. In the cavity unit, as shown in FIGS. 9, 10A, and 10B, thin width release grooves 34, 35 for the adhesive are formed as recesses on first surfaces of the mutually opposing surfaces of the plates which are disposed adjacently in the vertical direction. In FIG. 9, the release grooves 34, 35 for the adhesive, which are formed on the first surfaces of the base plate 14 disposed at the lowermost layer, the spacer plate 13 disposed at the second layer from the bottom, and the manifold plate 12 disposed at the third layer from the bottom, are arranged so that they are directed upwardly.

Air release holes 37, 38 are bored at positions to make the communication with the release grooves 34, 35, the positions being vertically identical positions of the flat surfaces of the respective plates 12, 13 to be stacked so that they are communicated with each other in the vertical direction while making the penetration through the plate thicknesses of the respective plates 12, 13. The manifold plate 11 disposed at the uppermost layer (or base plate 14 when the base plate 14 is disposed at the uppermost layer) is formed with openings 136 to make the penetration through the plate thickness at positions to make the communication with the air release holes 37, 38. The openings 136 are open to the outside. Air release holes 136*a*, which are formed on the base plate 14 disposed at the lowermost layer, are recesses which have approximately the same depths (about the half of the plate thickness) as those of the release grooves 34 (35) and which are not communicated with the lower surface side (see FIGS. 10A and 10B).

The diameters D2 of the air release holes 37, 38 formed for the plates 12, 13 disposed at the intermediate layers except for the plate 11 disposed at the uppermost layer and the plate 14 disposed at the lowermost layer are formed to be larger than at least the diameter D1 of the openings 136 formed for the plate 11 disposed at the uppermost layer. Further, the diameters D2 of the air release holes 37, 38 are formed to be larger than the widths of the release grooves 34, 35. Owing to the diameter D2, when the adhesive 41 is moved along the overlay surfaces of the respective plates 11 to 14 during the stacking process, then the air release holes 37, 38 having the large diameters formed for the intermediate layers secure the release routes for the air (bubbles) contained in the adhesive 41 in a mixed manner, and the air release holes 37, 38 create adhesive pools to prevent the adhesive 41 from any leakage to the outer circumferential edges of the respective plates (see FIG. 10B).

As shown in FIG. 8, when the lead frames are stacked, the adhesive 41 is previously applied to plate-stacking surfaces of the lead frames 100*a* to 100*d*. One of the methods for applying the adhesive 41 is as follows. That is, the adhesive 41 is previously applied in thin thickness onto a flat surface of a jig, and the plate-stacking surface of each of the lead frames 100*a* to 100*d* is placed and overlaid on the applied surface. Accordingly, it is possible to transfer the adhesive 41, for example, to the flat land surface other than the recesses of, for example, the release grooves 34, 35, the pressure chambers 16, the second end flow passages 16*b*, the throttle sections 16*d*, and the air release holes 136*a* of the base plate 14. The adhesive 41 may be transferred by making the pressing abutment of the plate-stacking surface against a roller surface to which the adhesive 41 has been applied.

Subsequently, pins are inserted into the positioning holes 105 to press, adhere, and fix the lead frames 100*a* to 100*d* by allowing the pressing force or the interposing force to act on the lead frame 100*d* disposed at the lowermost layer and the lead frame 100*a* disposed at the uppermost layer.

When the plurality of lead frames, to which the adhesive 41 has been transferred, are pressed as described above to adhere and fix the wide width surfaces of the respective plates 11, 12, 13, 14, any excessive adhesive 41 inflows into the release grooves 34, 35. Subsequently, as shown in FIG. 10B, the air release holes 136*a*, 37, 38 are filled with the excessive adhesive 41. During this process, the air, which is caught up in the adhesive 41 or by the overlay surfaces (wide width surfaces) of the adjoining plates 11, 12, 13, 14, behaves as bubbles which are moved together with the adhesive 41 in the release grooves 34, 35 in the lateral direction and the air release holes 136*a*, 37, 38 in the vertical direction and which are discharged to the outside of the plates from the openings 136. As a result, it is possible to form stable adhesive/seal layers by means of the adhesive 41 formed in layered configurations without containing any bubble on the overlay surfaces (wide width surfaces) of the adjoining plates 11, 12, 13, 14. Further, the diameters D2 of the air release holes 37, 38 of the intermediate layers are larger than those of the openings 136, namely the cavity volume (capacity) of the air release hole is large. Therefore, the excessive adhesive 41 is accumulated in the air release holes 37, 38, and it is possible to greatly decrease the amount of the adhesive 41 which outflows from the openings 136 to the outside of the cavity unit 9. Further, the adhesive intends to stay at the boundary wall surface between the opening 136 and the air release hole 38 on account of the capillary phenomenon, because the diameter D2 of the air release hole 37, 38 is larger than the diameter D1 of the opening 136. Therefore, the adhesive hardly goes out of the opening 136.

The air release grooves 136*a* of the plate 14 disposed at the lowermost layer may be formed to have large diameters. However, the air release grooves 136*a* of the plate 14 disposed at the lowermost layer may have the same diameter as the width of the release groove 35, because the adhesive inflows from the release grooves 35 into the air release holes 38 having the large diameters.

Therefore, the adhesive scarcely overflows to the outside from the openings 136 of the plate disposed at the uppermost layer, and the adhesive hardly adheres to the pressing and joining apparatus. It is also possible to decrease the number of times of the execution of the maintenance operation which would be otherwise performed such that any excessive cleaning operation is conducted in order to clean and treat the adhesive. Further, the following effect is also obtained. That is, it is possible to decrease the frequency of exchange of the installation of the sheet to avoid the adhesion of the adhesive with respect to the pressing and joining apparatus when the pressing and joining operation is performed.

After that, when the air release holes 136 are sealed with a seal material such as an adhesive at the upper surface of the manifold plate 11 disposed at the uppermost layer, it is possible to reliably effect the closure with the seal material, because the upper surface of the manifold plate 11 is the smooth wide width surface, and the sealing is effected on this surface. As a result, it is possible to reliably avoid the leakage of the ink to the outside of the cavity unit 9 from the ink flow passages of the respective plates 11, 12, 13, 14 including, for example, the common ink chambers 12*a*, 12*b*, the communication holes 17, the ink flow passages 18, and the respective pressure chambers 16 as well as the tip flow passages 16*a* and the second end flow passages 16*b*.

In the capillary phenomenon in which the (liquid) adhesive 41 having the low viscosity passes through the narrow gap such as those between the overlay surfaces of the plates (including, for example, the base plate 14 in this case and in the following cases as well), the adhesive 41 is preferentially attracted to portions having small cross-sectional areas with the large capillary force prior to portions having large cross-sectional areas. Therefore, when the cross-sectional areas of the release grooves 34, 35 are established to be smaller than the respective cross-sectional areas of the ink flow passages 18, the communication holes 17, and the throttle sections 16*d* to make the communication to the pressure chambers 16 from the second end flow passages 16*b* as the ink flow passages, then the adhesive 41, which is disposed on the overlay surface of the plate, behaves such that the adhesive 41 is introduced via the release grooves 34, 35 into the air release holes 37, 38 of the intermediate layers having the large cavity volume (capacity) prior to the respective ink flow passages, and thus it is possible to prevent the ink flow passages from being closed by the adhesive 41.

Figure 11:
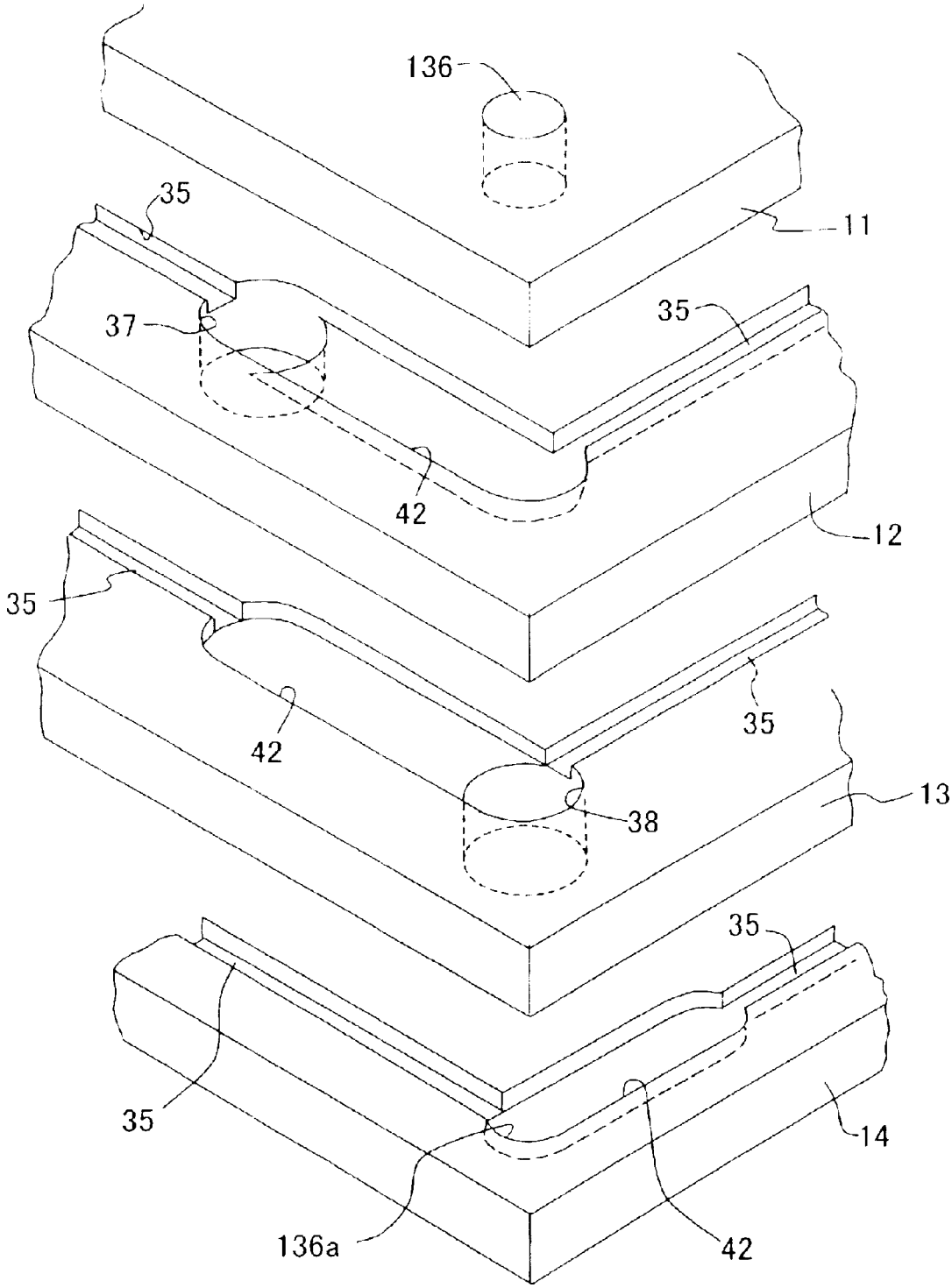
FIG. 11 shows a magnified perspective view illustrating major parts depicting, for example, release grooves, enlarged adhesive pools, and air release holes according to a second embodiment.
Figure 12A:
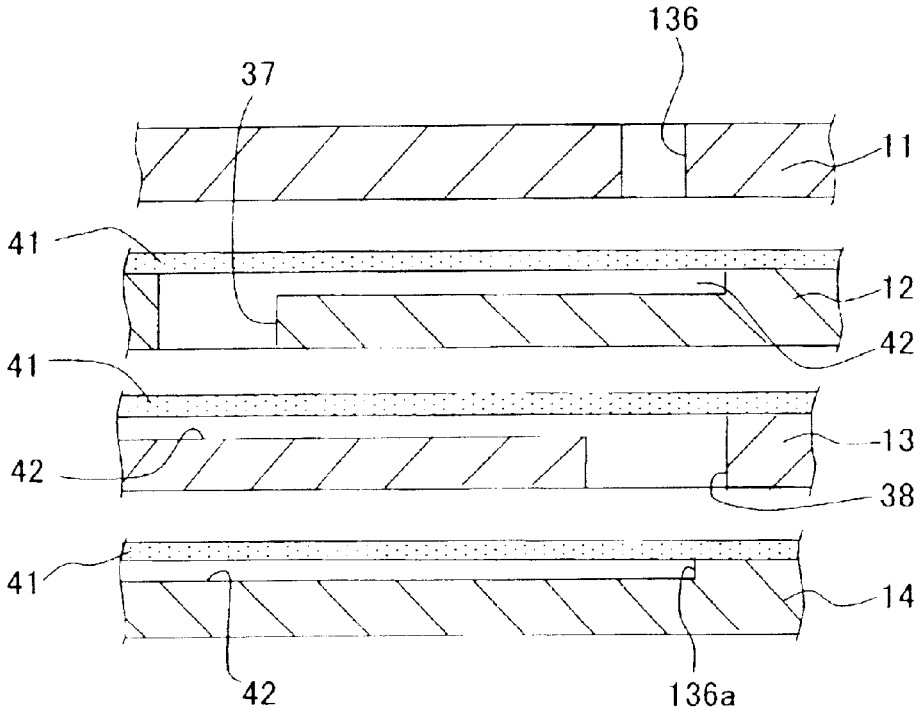
FIG. 12A shows a sectional view illustrating, for example, release grooves and air release holes depicting a state of application of an adhesive prior to the stacking in the second embodiment.
Figure 12B:
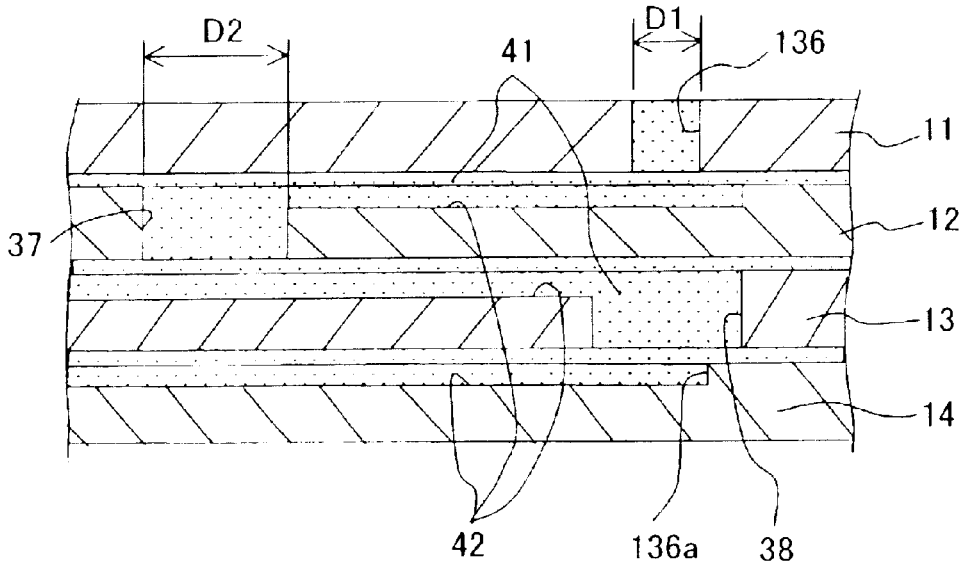
FIG. 12B shows a sectional view illustrating a stacked and adhered state of the respective plates.

In another embodiment shown in FIGS. 11, 12A, and 12B, an enlarged adhesive pool 42, which is formed so that the width, i.e., the area is enlarged as viewed in a plan view, is formed at a part of the release groove 35 disposed in the vicinity of each of the air release holes 37, 38. The enlarged adhesive pool 42 is formed as a recess by means of the half etching by a thickness of about the half of the plate thickness of each of the plates 12 to 14. It is preferable that the diameter of the air release hole is the same as the width of the enlarged adhesive pool 42. However, the former may be smaller than the latter. Any excessive adhesive 41, which is located on the intermediate layers during the joining with the adhesive 41, is pooled or accumulated in the enlarged adhesive pools 42. Therefore, it is possible to greatly decrease the amount of the adhesive 41 which would otherwise outflow to the outside of the cavity unit 9. The following effect is obtained. That is, it is possible to decrease the frequency of the maintenance operation in the same manner as described above.

In a modified embodiment of the foregoing embodiment, the positions of the air release holes 37, 38, and the opening 136 of the vertically adjoining plates are laterally deviated so that their axes are not coincident with each other (they are deviated so that the axes of the upper and lower air release holes, which extend in the stacking direction of the plates, are in discord). For example, as in the embodiment shown in FIGS. 11, 12A, and 12B, the air release hole 38 of the upper layer plate 13 is formed at the position to overlap with a part of the enlarged adhesive pool 42 of the lowermost layer plate 14 as viewed in the plan view, the air release hole 37 of the upper layer plate 12 is formed at the position to overlap with a part of the enlarged adhesive pool 42 of the plate 13 as viewed in the plan view, and the opening 136 of the upper layer plate 11 is formed at the position to overlap with a part of the enlarged adhesive pool 42 of the plate 12 as viewed in the plan view. In this arrangement, it is established that at least the axes of the vertically adjoining air release holes are laterally deviated from each other so that they are not coincident with each other.

When the positions of the upper and lower air release holes are laterally deviated as described above, the adhesive 41, which is applied to the overlay surfaces of the plates 11 to 14, is accumulated in the enlarged adhesive pools 42 as a result of the inflow thereinto from the release grooves 34, 35 during the pressing and joining process, and then the adhesive 41 is moved toward the plate disposed at the upper layer via the air release holes penetrating in the vertical direction of the respective plates. Thus, the adhesive 41 is moved along with the zigzag routes. Therefore, the adhesive 41 having the small viscosity does not suddenly arrive at the upper layer plate. The adhesive 42 is reliably captured in the air release holes 37 (38) having the large diameters and the enlarged adhesive pools 42 of the respective layers. It is possible to decrease the amount of protrusion of the adhesive 41 to the outside of the cavity unit 9.

The interconnecting tabs 106 are cut from the lead frames 100*a* to 100*d* (see FIG. 8) having been adhered and fixed as described above, and the integrated cavity units 9 are removed. After that, the nozzle plate 10 is fixed with the adhesive as well. The cavity unit 9 is constructed as follows. That is, the ink inflows into the common ink chambers 12*a*, 12*b* from the supply holes 19*a*, 19*b* bored through the first ends of the base plate 14 and the spacer plate 13. The ink passes from the common ink chambers 12*a* via the respective ink flow passages 18, and the ink is distributed into the respective pressure chambers 16. After that, the ink passes from the respective pressure chambers 16 via the communication holes 17, 17, 17, and the ink arrives at the nozzles 15 corresponding to the pressure chambers 16.

The piezoelectric actuator 20 is assembled and attached to the cavity plate in the same manner as explained in the first embodiment.

Third Embodiment

Figure 13:
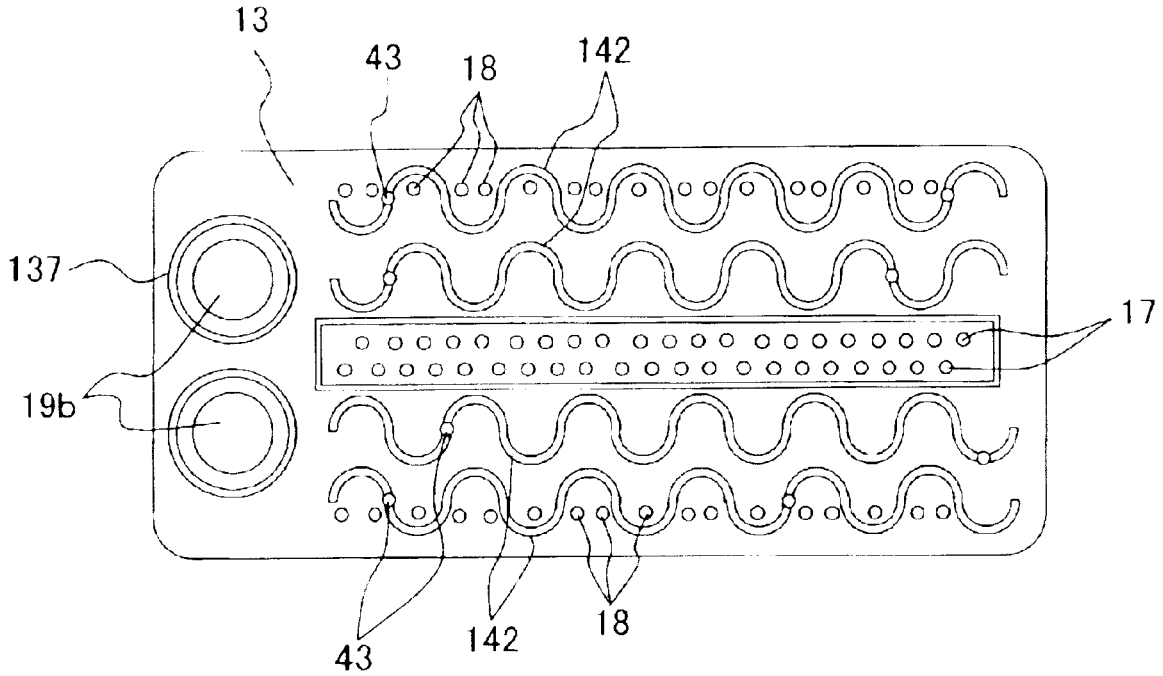
FIG. 13 shows a plan view illustrating release grooves according to a third embodiment.

A third embodiment of the present invention will be explained below with reference to FIG. 13. FIG. 13 shows shapes of release grooves 142 as viewed in plan view according to a third embodiment. In this embodiment, the respective release grooves 142 are formed by means of the half etching to have a meandering form as viewed in plan view on one surface of each of plates 11 to 14. FIG. 13 shows a case in which the plurality of meandering release grooves 142 are formed to have long dimensions along the long side on one surface of the spacer plate 13. Air release holes 43, which penetrate in the plate thickness direction of the spacer plate 13, are provided at appropriate positions of the release grooves 142. The other constitutive components of the spacer plate 13 are the same as those in the first embodiment. Therefore, the same constitutive components are designated by the same reference numerals, any detailed explanation of which is omitted.

Few portions of the release grooves 142 according to the third embodiment are parallel to the long side direction and the short side direction of the respective plates. Therefore, even when any bending moment acts on a cavity unit 9 obtained by stacking the plurality of plates 11 to 14, for example, so that an intermediate portion in the long side direction is greatly bent, the rigidity against the bending moment is not greatly decreased (lowered) locally. Thus, it is possible to obtain the cavity unit 9 having a high degree of strength even though the thickness is thin.

Fourth Embodiment

Figure 14:
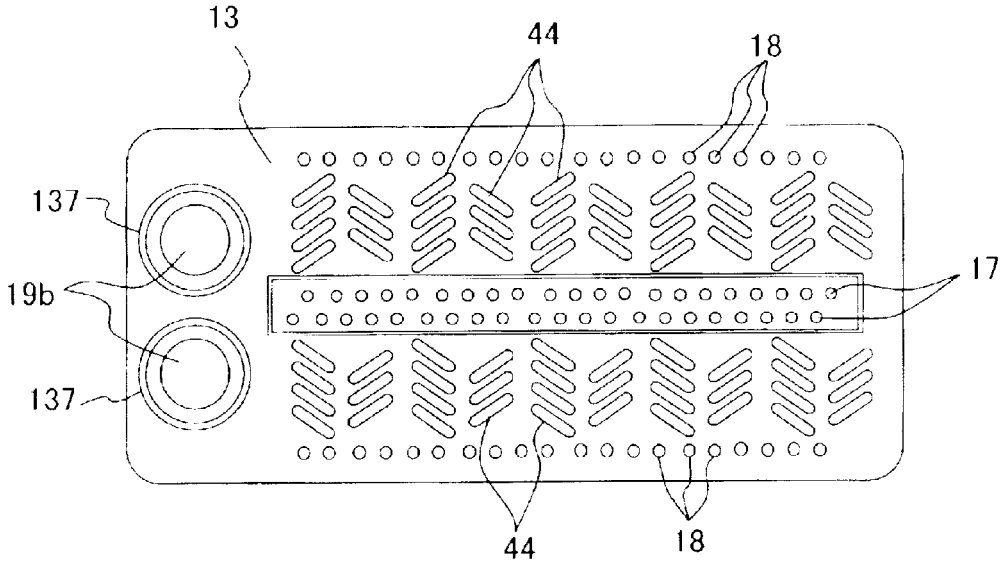
FIG. 14 shows a plan view illustrating release grooves according to a fourth embodiment.
Figure 15:
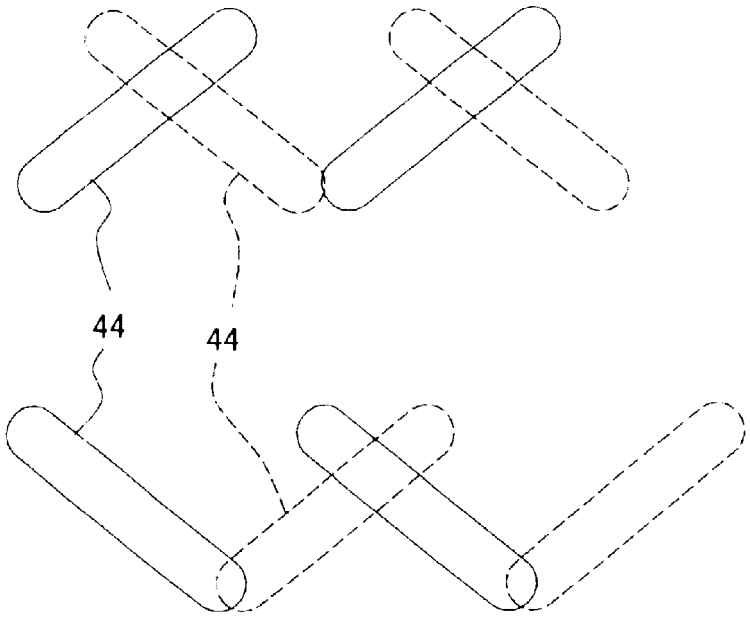
FIG. 15 shows a plan view illustrating major parts of release grooves depicting a state of stacking in the fourth embodiment.

A fourth embodiment of the present invention will be explained below with reference to the drawings. FIGS. 14 and 15 show shapes of release grooves 44 according to a fourth embodiment as viewed in plan view. The respective release grooves 44 are formed so that they extend in inclined directions with respect to the long side direction and the short side direction of each of plates (directions not perpendicular thereto) as viewed in plan view on one surface of each of the plates 11 to 14. The respective release grooves 44 are formed by means of the half etching. FIG. 14 shows a case in which the plurality of release grooves 44 are formed on one surface of the spacer plate 13 so that the directions of inclination of the release grooves 44 are alternately changed oppositely in the longitudinal direction, i.e., in a separated and inverted V-shaped form as viewed in plan view. Although not shown, air release holes, which penetrate in the plate thickness direction of the plate, may be provided at appropriate positions of the respective release grooves 44. Further, as shown in FIG. 15, it is desirable that the release grooves 44 are formed at deviated positions so that the release grooves 44, which are formed on the adjoining stacked plates, are not superimposed completely as viewed in plan view when the plurality of plates are stacked. The other constitutive components of the spacer plate 13 are the same as those in the first embodiment. Therefore, the same constitutive components are designated by the same reference numerals, any detailed explanation of which is omitted.

No portions of the release grooves 44 according to the fourth embodiment are parallel to the long side direction and the short side direction of the respective plates in the directions in which the release grooves 44 extend. Further, the release grooves 44 are not parallel to only one direction as a whole as well. Therefore, even when any bending moment acts on a cavity unit 9 obtained by stacking the plurality of plates 11 to 14, for example, so that an intermediate portion in the long side direction is greatly bent, the rigidity against the bending moment is not greatly decreased (lowered) locally. Thus, it is possible to obtain the cavity unit 9 having a high degree of strength even though the thickness is thin.

Fifth Embodiment

Figure 16:
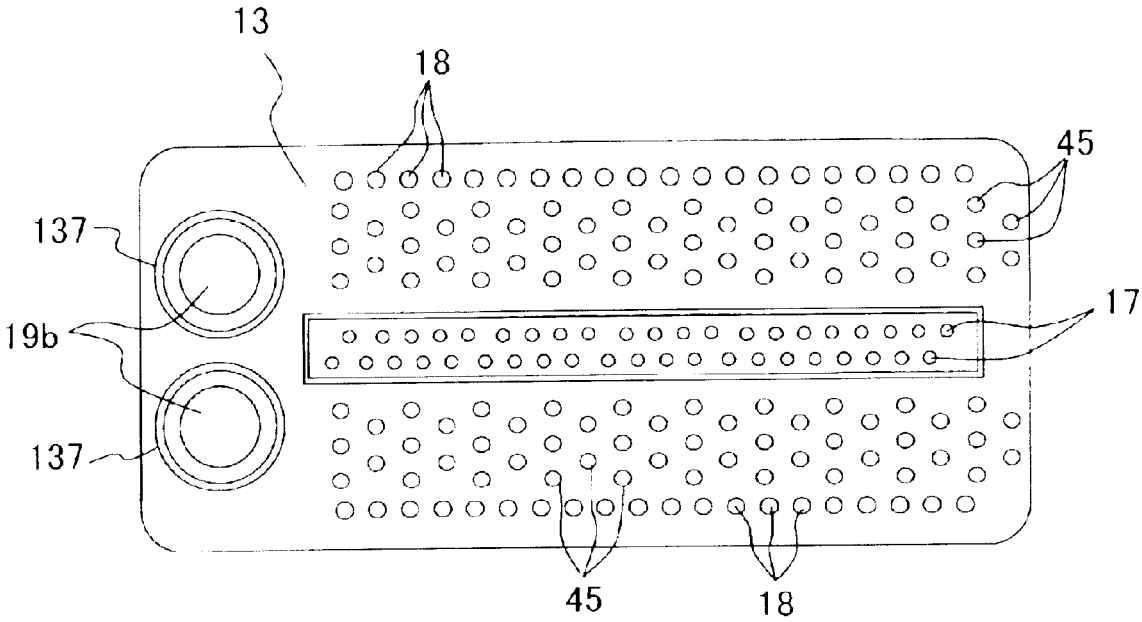
FIG. 16 shows a plan view illustrating anchor holes according to a fifth embodiment.

A fifth embodiment of the present invention will be explained below with reference to the drawings. FIGS. 16, 17A to 17C show the fifth embodiment in which a plurality of anchor holes 45 are bored penetratingly in the plate thickness direction of each of plates. The shape of each of the anchor holes 45 is circular as viewed in plan view. FIG. 16 shows the large number of anchor holes 45 which are arranged for the spacer plate 13 in the zigzag arrangement as viewed in plan view. As shown in FIG. 17C, it is desirable that the anchor holes 45 are formed at deviated positions at which the anchor holes 45 formed through the adjoining stacked plates are not superimposed completely as viewed in plan view when the plurality of plates are stacked.

The other constitutive components of the spacer plate 13 are the same as those in the first embodiment. Therefore, the same constitutive components are designated by the same reference numerals, any detailed explanation of which is omitted.

Figure 17A:
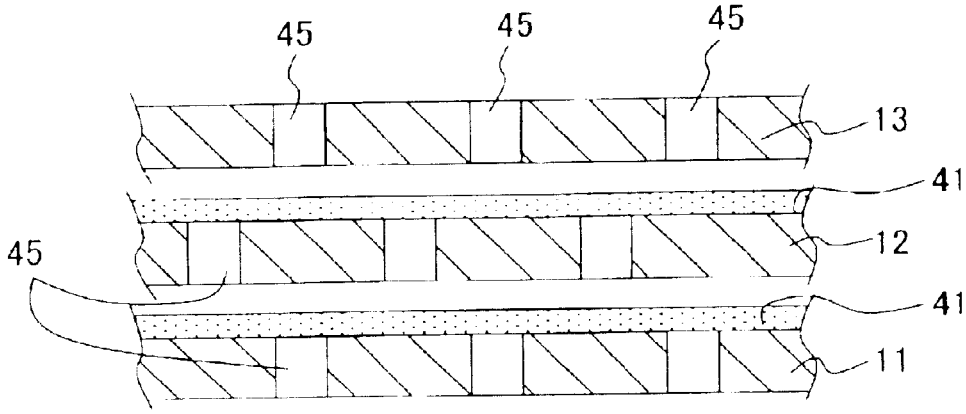
FIG. 17A shows a sectional view illustrating, for example, anchor holes depicting a state of application of an adhesive prior to the stacking in the fifth embodiment.
Figure 17B:
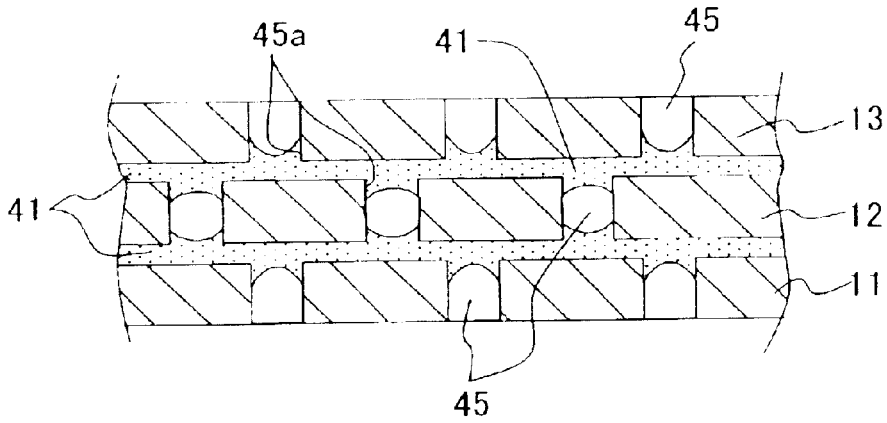
FIG. 17B shows a sectional view illustrating respective plates depicting a stacked and adhered state.
Figure 17C:
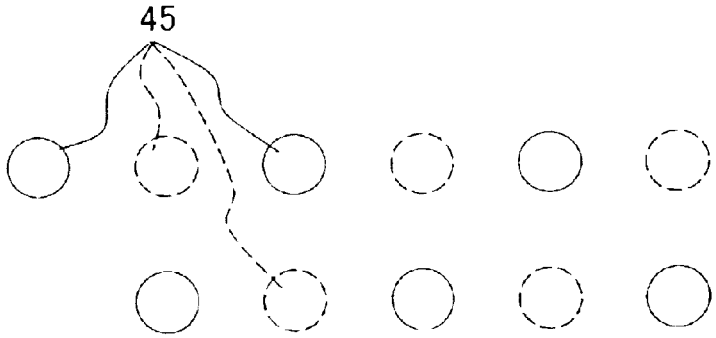
FIG. 17C shows a plan view illustrating major parts depicting an arrangment of the anchor holes in a stacked condition.

In the fifth embodiment, an adhesive 41 is previously applied to one surface of each of the plates 11 and 12 as shown in FIG. 17A, and then the pressure is applied while adjusting the positions of the plurality of plates 11 to 13 stacked in the vertical direction to stack and join the plates 11 to 13 by the aid of the adhesive 41 thereby as shown in FIG. 17B. Accordingly, the excessive adhesive 41 enters the respective anchor holes 45, and the adhesive 41 is adhered to at least portions 45*a* of the circumferential surfaces of the anchor holes 45 so that the force is allowed to act to fasten the both plates (referred to as "anchoring effect"). Therefore, it is possible to effect the powerful joining function as compared with the joining force brought about by the adhesive based on only the areas of the stacking surfaces at which the plates are opposed to one another. Further, the anchor holes 45 penetrate in the plate thickness direction of each of the plates. Therefore, the air release function is also provided such that the air, which stays on the stacking surfaces and in the anchor holes 45, can be released to the outside via the anchor holes 45 when the respective plates are joined to one another with the adhesive 41. Additionally, an effect is obtained such that the air release function is facilitated when portions of the anchor holes 45 are arranged to make the communication in the stacking direction at the adjoining stacked portions of the plates.

The large number of anchor holes 45 are disposed in the zigzag arrangement as viewed in plan view when the anchor holes 45 are bored through one plate. Accordingly, it is possible to increase the spacing distances between the mutually adjoining anchor holes 45 as compared with a case in which identical numbers of anchor holes 45 are arranged linearly in the long side direction and the short side direction of the plate. Thus, it is possible to minimize the decrease (lowering) of the rigidity with respect to the bending of the cavity unit 9. Further, the rigidity against the bending moment is not greatly decreased (lowered) locally, because the mutually adjoining anchor holes 45 of one plate are not connected to one another in the in-plane direction of the plate. It is possible to obtain the cavity unit 9 having a high degree of strength even though the thickness is thin.

Figure 18A:
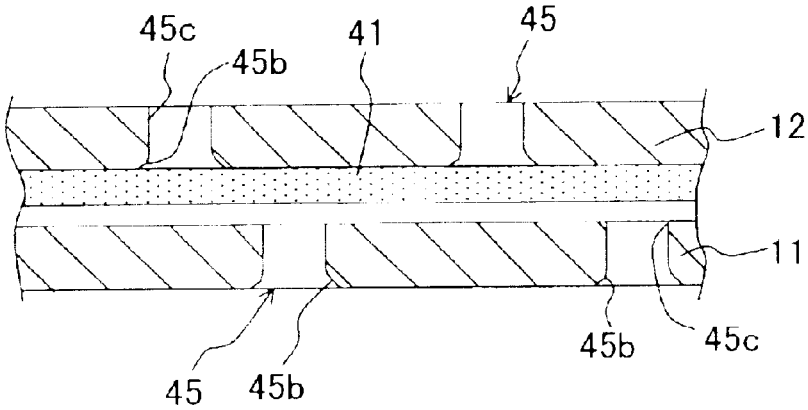
FIG. 18A shows a sectional view illustrating thin plates depicting a state of application of an adhesive prior to the stacking.
Figure 18B:
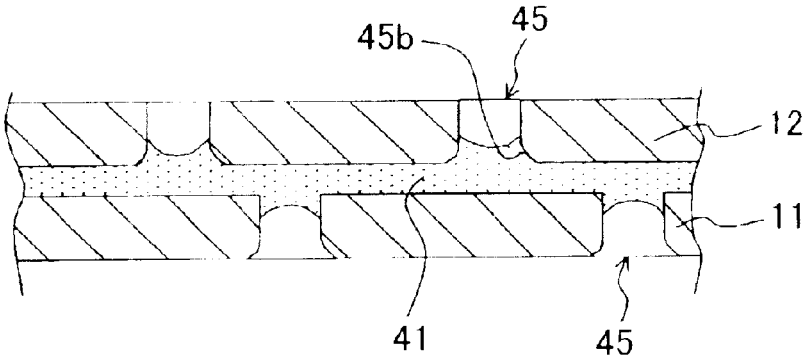
FIG. 18B shows a sectional view illustrating respective plates in a stacked and adhered condition.
Figure 18C:
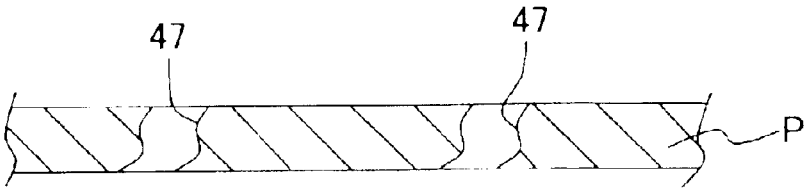
FIG. 18C shows a sectional view illustrating, for example, anchor holes in other modified embodiment.
Figure 19:
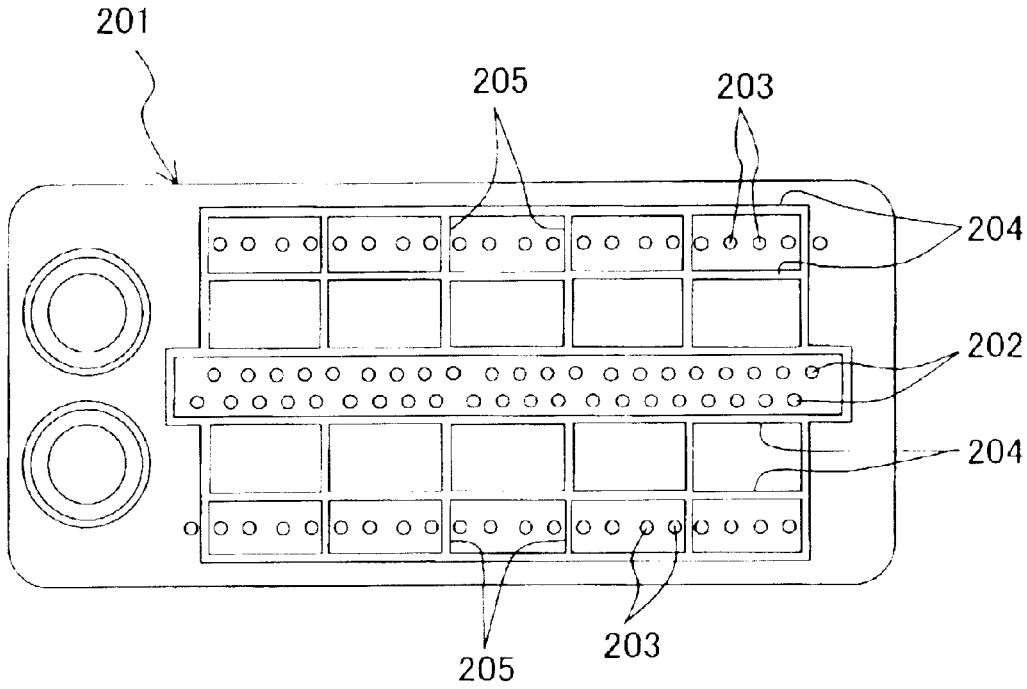
Fig. 19 RELATED ART
FIG. 19 shows a plan view illustrating a state of release grooves for the adhesive in the case of an exemplary conventional technique.

FIGS. 18A and 18B show a modified embodiment of the anchor holes 45. For example, when the plates 11 and 12 are stacked and joined, the anchor holes 45 may be formed to have such diameters that large diameter portions 45*b* are formed on one surface side of the plate, and small diameter portions 45*c* are formed on the other surface side of the plate. Owing to the adhesive 41 entered the large diameter portions 45*b*, it is possible to further increase the joining area, and thus it is possible to enhance the anchoring effect. Alternatively, as shown in FIG. 18C, the anchor holes 47 may be formed and bored so that positions at which the anchor holes 47 are open on one surface of the plate P are deviated from positions at which they are open on the other surface. Further alternatively, the shape of the anchor hole 45, 47 as viewed in plan view is not limited to the shape of circular hole. It is possible to adopt arbitrary shapes including, for example, elliptic shapes, oblong circular shapes such as oval shapes, and rectangular shapes. It is preferable that the respective anchor holes 45, 47 are bored through the plate made of metal by means of the etching.

When a large number of anchor holes 45 having circular shapes are bored, then the distance L to the adjoining anchor hole 45 may be made larger than the diameter D of the anchor hole 45 (D<L), or the distance L may be made larger than the plate thickness T of the plate P (T<L). Accordingly, it is possible to minimize the decrease (lowering) of the bending rigidity of the cavity unit 9 to be as small as possible.

The present invention has been applied to the assembling of the ink-jet head in the respective embodiments described above. However, the present invention is also applicable to the assembling of electronic parts. In this case, the present invention is most appropriate to a structure obtained by stacking and fixing a plurality of thin plate-shaped parts such as a plurality of lead frames including at least one thin plate-shaped part in which a liquid flow passage is formed in a predetermined pattern on at least one surface.

What is claimed is:

1. A thin plate stacked structure comprising a plurality of thin plates which are stacked with an adhesive, the plurality of thin plates including at least one liquid flow passage thin plate provided with a liquid flow passage having a predetermined pattern formed on at least one surface, the stacked structure further comprising:

a release groove which is formed on the liquid flow passage thin plate and which releases the adhesive;

an air release hole which is bored through a thin plate stack stacked on the liquid flow passage thin plate, which is communicated with the release groove, and which penetrates in a stacking direction; and an opening which is formed on the thin plate disposed at an outermost layer of the thin plate stack and which allows the air release hole to be open to the outside, wherein:

the air release hole has a diameter which is larger than a width of the release groove and which is larger than the opening disposed at the outermost layer.

2. The stacked structure according to claim 1, wherein the release groove is formed outside the liquid flow passage on the liquid flow passage thin plate.

3. The stacked structure according to claim 1, wherein a hole for defining the air release hole is formed through each of the thin plates for constructing the stack.

4. The stacked structure according to claim 1, wherein the liquid flow passage having the predetermined pattern is composed of a plurality of through-holes arranged in a certain direction.

5. An ink-jet recording head comprising a cavity plate which is composed of the stacked structure as defined in claim 1, and an actuator, wherein the cavity plate has a plurality of nozzles, and the liquid flow passage is an ink flow passage for allowing an ink to pass from an ink supply source to the nozzles.

* * * * *